US009976283B2

(12) United States Patent
Tsuruga et al.

(10) Patent No.: US 9,976,283 B2
(45) Date of Patent: May 22, 2018

(54) HYDRAULIC DRIVE SYSTEM FOR CONSTRUCTION MACHINE

(71) Applicant: Hitachi Construction Machinery Tierra Co., Ltd., Koka-shi, Shiga (JP)

(72) Inventors: Yasutaka Tsuruga, Ryuugasaki (JP); Kiwamu Takahashi, Moriyama (JP); Yasuharu Okazaki, Namerikawa (JP); Hiroyuki Nobezawa, Takaoka (JP); Kenji Yamada, Toyama (JP)

(73) Assignee: Hitachi Construction Machinery Tierra Co., Ltd., Koka-shi (JP)

( * ) Notice: Subject to any disclaimer, the term of this patent is extended or adjusted under 35 U.S.C. 154(b) by 50 days.

(21) Appl. No.: 15/027,016

(22) PCT Filed: Nov. 26, 2014

(86) PCT No.: PCT/JP2014/081146
§ 371 (c)(1),
(2) Date: Apr. 4, 2016

(87) PCT Pub. No.: WO2015/080112
PCT Pub. Date: Jun. 4, 2015

(65) Prior Publication Data

US 2016/0258133 A1 Sep. 8, 2016

(30) Foreign Application Priority Data

Nov. 28, 2013 (JP) ..... 2013-246803

(51) Int. Cl.
*F15B 11/17* (2006.01)
*E02F 9/22* (2006.01)
(Continued)

(52) U.S. Cl.
CPC ..... *E02F 9/2235* (2013.01); *E02F 9/2228* (2013.01); *E02F 9/2232* (2013.01);
(Continued)

(58) Field of Classification Search
CPC ..... F15B 11/17; F15B 2211/6655; F15B 2211/6652; F15B 2211/20576;
(Continued)

(56) References Cited

U.S. PATENT DOCUMENTS 4,880,359 A * 11/1989 Hoffmeister ..... F16H 61/433 417/216
6,644,025 B1 * 11/2003 Oberhausser ..... F15B 11/163 60/422
(Continued)

FOREIGN PATENT DOCUMENTS

EP 2 662 576 A1 11/2013
JP 59-194105 A 11/1984
(Continued)

OTHER PUBLICATIONS

International Preliminary Report on Patentability (PCT/IB/338 & PCT/IB/373) issued in PCT Application No. PCT/JP2014/081146, including English translation of Written Opinion (PCT/ISA/237) dated Jun. 9, 2016 (six (6) pages).
(Continued)

*Primary Examiner* — Thomas E Lazo
(74) *Attorney, Agent, or Firm* — Crowell & Moring LLP

(57) ABSTRACT

It is an object of the present invention to accurately detect the absorption torque of the other of two hydraulic pumps by a purely hydraulic structure and feed the absorption torque to one of the two hydraulic pumps, thereby to accurately perform a total torque control, effectively utilize a rated output torque of a prime mover, and enhance mountability. To achieve the object, there are provided: a torque feedback circuit 31 to which the delivery pressure of a first hydraulic pump 1*a* and a load sensing drive pressure are introduced, which modifies the delivery pressure of a second hydraulic pump 1*b* to provide a characteristic simulating the absorption torque of the second hydraulic pump 1*b*, and which
(Continued)

outputs the modified pressure; and torque feedback pistons 32*a*, 32*b* to which the output pressure of the torque feedback circuit 31 is introduced, and which control the capacity of the first hydraulic pump 1*a* to decrease the capacity of the first hydraulic pump 1*a* and decrease a maximum torque T1max as the output pressure becomes higher. The torque feedback circuit 31 includes pressure dividing restrictor parts 34*a*, 34*b*, pressure dividing valves 35*a*, 35*b*, and relief valves 37*a*, 37*b*.

4 Claims, 13 Drawing Sheets

(51) Int. Cl.

| | |
|---|---|
| ***F15B 13/02*** | (2006.01) |
| ***F15B 13/08*** | (2006.01) |
| *F15B 20/00* | (2006.01) |
| *E02F 3/32* | (2006.01) |

(52) U.S. Cl.
CPC ..... *E02F 9/2267* (2013.01); *E02F 9/2292* (2013.01); *E02F 9/2296* (2013.01); *F15B 11/17* (2013.01); *F15B 13/025* (2013.01); *F15B 13/026* (2013.01); *F15B 13/0803* (2013.01); *E02F 3/325* (2013.01); *F15B 20/007* (2013.01); *F15B 2211/20523* (2013.01); *F15B 2211/20546* (2013.01); *F15B 2211/20553* (2013.01); *F15B 2211/20576* (2013.01); *F15B 2211/25* (2013.01); *F15B 2211/6652* (2013.01); *F15B 2211/6655* (2013.01)

(58) Field of Classification Search
CPC ..... F15B 2211/20553; E02F 9/2292; E02F 9/2296; E02F 9/2232
See application file for complete search history.

(56) References Cited

U.S. PATENT DOCUMENTS

| | | | | |
|---|---|---|---|---|
| 7,076,947 | B2 * | 7/2006 | Ariga | E02F 9/2232 60/452 |
| 2004/0020082 | A1 | 2/2004 | Ariga et al. | |
| 2006/0207248 | A1 | 9/2006 | Ariga et al. | |
| 2013/0287601 | A1 * | 10/2013 | Mori | E02F 9/2225 417/364 |
| 2014/0174068 | A1 | 6/2014 | Mori et al. | |

FOREIGN PATENT DOCUMENTS

| | | | |
|---|---|---|---|
| JP | 3-7030 | B2 | 1/1991 |
| JP | 7-189916 | A | 7/1995 |
| JP | 9-209415 | | 8/1997 |
| JP | 2006-161509 | A | 6/2006 |
| JP | 3865590 | B2 | 10/2006 |
| JP | 2011-196438 | A | 10/2011 |
| WO | WO 2013/031768 | A1 | 3/2013 |

OTHER PUBLICATIONS

European Extended Search Report issued in counterpart European Patent Application No. 14866109.3 dated Jul. 4, 2017 (Seven (7) pages).

* cited by examiner

HYDRAULIC DRIVE SYSTEM FOR CONSTRUCTION MACHINE

TECHNICAL FIELD

The present invention relates to a hydraulic drive system for a construction machine such as hydraulic excavator. Particularly, the invention relates to a hydraulic drive system for a construction machine that includes at least two variable displacement hydraulic pumps, one of which has a pump control unit (regulator) performing at least a torque control and the other of which has a pump control unit (regulator) performing a load sensing control and a torque control.

BACKGROUND ART

As a hydraulic drive system for a construction machine such as hydraulic excavator, one having a regulator that controls the capacity (flow rate) of a hydraulic pump in such a manner that the delivery pressure of the hydraulic pump becomes higher than a maximum load pressure of a plurality of actuators by a target differential pressure is widely used, and this is called load sensing control. Patent Document 1 describes a two-pump load sensing system in a hydraulic drive system for a construction machine provided with a regulator for performing such a load sensing control, in which two hydraulic pumps are provided, and the respective two hydraulic pumps perform the load sensing control.

Besides, in a regulator of a hydraulic drive system for a construction machine, normally, a torque control is conducted such that the absorption torque of a hydraulic pump does not exceed a rated output torque of a prime mover, by decreasing the capacity of the hydraulic pump as the delivery pressure of the hydraulic pump rises, thereby to prevent stoppage of the prime mover (engine stall) due to an overtorque. In the case where the hydraulic drive system is provided with two hydraulic pumps, the regulator of one hydraulic pump performs a torque control (total torque control) by using not only its own delivery pressure but also a parameter concerning the absorption torque of the other hydraulic pump, thereby to attain both prevention of stoppage of the prime mover and effective utilization of a rated output torque of the prime mover.

For instance, in Patent Document 2, a total torque control is carried out by introducing the delivery pressure of one of the two hydraulic pumps to the regulator of the other hydraulic pump through a pressure reduction valve. A set pressure of the pressure reduction valve is fixed, and this set pressure is set at a value simulating a maximum torque in the torque control of the regulator of the other hydraulic pump. This ensures that in an operation of driving only the actuators concerning the one hydraulic pump, the one hydraulic pump can effectively use substantially the whole of the rated output torque of the prime mover, and, in a combined operation of simultaneously driving the actuators concerning the other hydraulic pump, the absorption torque of the whole of the pumps does not exceed the rated output torque of the prime mover, so that stoppage of the prime mover can be prevented from occurring.

In Patent Document 3, in order to carry out a total torque control for two variable displacement hydraulic pumps, the tilting angle of the other hydraulic pump is detected as an output pressure of a pressure reduction valve, and the output pressure is introduced to the regulator of the one hydraulic pump. In Patent Document 4, control accuracy of a total torque control is enhanced by detecting the tilting angle of the other hydraulic pump by replacing the tilting angle with the arm length of an oscillating arm.

PRIOR ART DOCUMENTS

Patent Documents

Patent Document 1: JP-2011-196438-A
Patent Document 2: Japanese Patent No. 3865590
Patent Document 3: JP-1991-7030-B
Patent Document 4: JP-1995-189916-A

SUMMARY OF THE INVENTION

Problem to be Solved by the Invention

By applying the technology of the total torque control described in Patent Document 2 to the two-pump load sensing system described in Patent Document 1, it is possible to perform a total torque control also in the two-pump load sensing system described in Patent Document 1. In the total torque control of Patent Document 2, however, the set pressure of the pressure reduction valve is set at a fixed value simulating the maximum torque for the torque control of the other hydraulic pump, as aforementioned. Therefore, in a combined operation of simultaneously driving the actuators concerning the two hydraulic pumps, when the other hydraulic pump is in such an operating state that the other hydraulic pump is limited by the torque control and operates at the maximum torque for the torque control, it is possible to contrive effective utilization of a rated output torque of the prime mover. However, when the other hydraulic pump is in such an operating state that the other hydraulic pump is not limited by the torque control and performs a capacity control by the load sensing control, there occurs the following problem: notwithstanding the absorption torque of the other hydraulic pump being smaller than the maximum torque for the torque control, the output pressure of the pressure reduction valve simulating the maximum torque is introduced to the one regulator of the hydraulic pump, and a control such as to decrease the absorption torque of the one hydraulic pump more than necessary would be performed. Consequently, it has been impossible to accurately perform the total torque control.

In Patent Document 3, it is attempted to enhance the accuracy of the total torque control, by detecting the tilting angle of the other hydraulic pump as the output pressure of the pressure reduction valve and introducing the output pressure to the regulator of the one hydraulic pump. However, there occurs a problem. In general, the torque of a pump is determined as the product of delivery pressure and capacity, specifically, (delivery pressure×pump capacity)/$2\pi$. On the other hand, in Patent Document 3, the delivery pressure of the one hydraulic pump is introduced to one of two pilot chambers of a stepped piston, whereas the output pressure of the pressure reduction valve (the delivery amount proportional pressure for the other hydraulic pump) is introduced to the other pilot chamber of the stepped piston, and the capacity of the one hydraulic pump is controlled using the sum of the delivery pressure and the delivery amount proportional pressure as a parameter of the output torque. Consequently, there would be generated a considerable error between the parameter and the torque being actually used.

In Patent Document 4, the control accuracy of the total torque control is enhanced by detecting the tilting angle of the other hydraulic pump by replacing the tilting angle with the arm length of an oscillating arm. However, the regulator in Patent Document 4 has a very complicated structure in which the oscillating arm and a piston provided in a regulator piston structure are slid relative to each other while transmitting a force. To provide a sufficiently durable structure, therefore, it is necessary to cause parts such as the oscillating arm and the regulator piston to be rigid, which makes it difficult to miniaturize the regulator. Particularly, in the small-type hydraulic excavator such as so-called rear small swing type having a small rear end radius, there have been the cases where the space for accommodating the hydraulic pump is so small that it is difficult to mount the hydraulic pump.

It is an object of the present invention to provide a hydraulic drive system for a construction machine that is provided with two variable displacement hydraulic pumps, one having a pump control unit to perform at least a torque control and the other performing a load sensing control and a torque control, in which the absorption torque of the other hydraulic pump is accurately detected by a purely hydraulic structure and fed back to the one hydraulic pump side, whereby it is possible to accurately carry out the total torque control, effectively utilize a rated output torque of a prime mover, and enhance mountability.

Means for Solving the Problem (1) To achieve the above object, the present invention provides a hydraulic drive system for a construction machine, including: a prime mover; a variable displacement first hydraulic pump driven by the prime mover; a variable displacement second hydraulic pump driven by the prime mover; a plurality of actuators driven by hydraulic fluids delivered by the first and second hydraulic pumps; a plurality of flow control valves that control flow rates of hydraulic fluids supplied from the first and second hydraulic pumps to the plurality of actuators; a plurality of pressure compensating valves that control differential pressures across the plurality of flow control valves; a first pump control unit that controls a delivery flow rate of the first hydraulic pump; and a second pump control unit that controls a delivery flow rate of the second hydraulic pump, the first pump control unit including a first torque control section that, when at least one of delivery pressure and capacity of the first hydraulic pump increases and absorption torque of the first hydraulic pump increases, controls the capacity of the first hydraulic pump such that the absorption torque of the first hydraulic pump does not exceed a first maximum torque, the second pump control unit including a second torque control section that, when at least one of delivery pressure and capacity of the second hydraulic pump increases and absorption torque of the second hydraulic pump increases, controls the capacity of the second hydraulic pump such that the absorption torque of the second hydraulic pump does not exceed a second maximum torque, and a load sensing control section that, when the absorption torque of the second hydraulic pump is lower than the second maximum torque, controls the capacity of the second hydraulic pump such that the delivery pressure of the second hydraulic pump becomes higher by a target differential pressure than a maximum load pressure of the actuators driven by a hydraulic fluid delivered by the second hydraulic pump, wherein the first torque control section includes a first torque control actuator that receives the delivery pressure of the first hydraulic pump and that, when the delivery pressure rises, controls the capacity of the first hydraulic pump to decrease the capacity of the second hydraulic pump and decrease the absorption torque thereof, and first biasing means that sets the first maximum torque, the second torque control section includes a second torque actuator that receives the delivery pressure of the second hydraulic pump and, when the delivery pressure rises, controls the capacity of the second hydraulic pump to decrease the capacity of the second hydraulic pump and decrease the absorption torque thereof, and second biasing means that sets the second maximum torque, the load sensing control section includes a control valve that varies a load sensing drive pressure such that the load sensing drive pressure is lowered as a differential pressure between the delivery pressure of the second hydraulic pump and the maximum load pressure becomes smaller than the target differential pressure, and a load sensing control actuator that controls the capacity of the second hydraulic pump to increase the capacity of the second hydraulic pump and increase the delivery flow rate as the load sensing drive pressure becomes lower, the first pump control unit further includes a torque feedback circuit that receives the delivery pressure of the second hydraulic pump and the load sensing drive pressure and modifies the delivery pressure of the second hydraulic pump based on the delivery pressure of the second hydraulic pump and the load sensing drive pressure to provide a characteristic simulating the absorption torque of the second hydraulic pump both in the cases of when the second hydraulic pump is limited by control of the second torque control section and operates at the second maximum torque and when the second hydraulic pump is not limited by control of the second torque control section and the load sensing control section controls the capacity of the second hydraulic pump, and then outputs the modified delivery pressure as a torque control pressure, and a third torque control actuator that receives the torque control pressure and controls the capacity of the first hydraulic pump to decrease the capacity of the first hydraulic pump and decrease the first maximum torque as the torque control pressure becomes higher, the torque feedback circuit includes a fixed restrictor that receives the delivery pressure of the second hydraulic pump, a variable restrictor valve located on a downstream side of the fixed restrictor and connected to a tank in the downstream side thereof, and a pressure limiting valve connected to a hydraulic line between the fixed restrictor and the variable restrictor valve to control the pressure in the hydraulic line such that the pressure does not increase beyond a pressure that initiates the control of the second torque control section, the variable restrictor valve is configured such that the variable restrictor valve is fully closed when the load sensing drive pressure is at a lowest pressure and that the opening area of the variable restrictor valve increases as the load sensing drive pressure rises, and the torque feedback circuit generates the torque control pressure based on the pressure in the hydraulic line between the fixed restrictor and the variable restrictor valve, the torque control pressure being introduced to the third torque control actuator.

In the present invention configured as above, when the second hydraulic pump is not limited by control of the second torque control section and the load sensing control section controls the capacity of the second hydraulic pump (when the delivery pressure of the second hydraulic pump is lower than a pressure that initiates the control of the second torque control section), the pressure in the hydraulic line between the fixed restrictor and the variable restrictor valve increases as the delivery pressure of the second hydraulic pump increases, and decreases as the load sensing drive pressure rises. This variation in the pressure is approximate to variation in the absorption torque of the second hydraulic pump that increases as the delivery pressure of the second hydraulic pump increases and that decreases as the load sensing drive pressure rises (the capacity of the second hydraulic pump decreases), in the case when the second hydraulic pump is not limited by the control of the second torque control section and the load sensing control controls the capacity of the second hydraulic pump. In addition, the torque control pressure is generated based on the pressure in the hydraulic line between the fixed restrictor and the variable restrictor valve, and variation in the torque control pressure is also approximate to variation in the absorption torque of the second hydraulic pump. As a result, the absorption torque of the second hydraulic pump can be accurately detected by a purely hydraulic structure, and the torque feedback circuit can modify the delivery pressure of the second hydraulic pump to provide a characteristic simulating the absorption torque of the second hydraulic pump and can output the modified pressure as a torque control pressure.

Besides, the torque control pressure is introduced to the third torque control actuator and the absorption torque of the second hydraulic pump is fed back to the side of the first hydraulic pump (the one hydraulic pump), whereby the first maximum torque set in the first torque control section of the first hydraulic pump can be decreased by the amount of the absorption torque of the second hydraulic pump, both in the cases of when the second hydraulic pump is limited by control of the second torque control section and operates at the second maximum torque and when the second hydraulic pump is not limited by the control of the second torque control section and the load sensing control section controls the capacity of the second hydraulic pump; accordingly, the total torque control can be carried out accurately and a rated output torque of the prime mover can be utilized effectively. In addition, since the absorption torque of the second hydraulic pump is detected on a purely hydraulic structure basis, the first pump control unit can be miniaturized, and mountability is enhanced.

(2) In the above paragraph (1), preferably, the torque feedback circuit further includes a pressure reduction valve that receives the delivery pressure of the second hydraulic pump as a primary pressure, the pressure in the hydraulic line between the fixed restrictor and the variable restrictor valve is introduced to the pressure reduction valve as a target control pressure for providing a set pressure of the pressure reduction valve, and the pressure reduction valve outputs the delivery pressure of the secondary hydraulic pump as a secondary pressure without reduction when the delivery pressure of the second hydraulic pump is lower than the set pressure, and reduces the delivery pressure of the second hydraulic pump to the set pressure and outputs the thus lowered pressure when the delivery pressure of the second hydraulic pump is higher than the set pressure, the output pressure of the pressure reduction valve being introduced to the third torque control actuator as the torque control pressure.

By thus generating the torque control pressure from the delivery pressure of the second hydraulic pump by the pressure reduction valve, it is possible to secure a flow rate at the time of driving the third torque control actuator by the torque control pressure and to improve the responsiveness at the time of driving the third torque control actuator.

In addition, since the pressure in the hydraulic line between the fixed restrictor and the variable restrictor valve is not directly used as the torque control pressure, the setting of the fixed restrictor and the variable restrictor valve for obtaining a required target control pressure and the setting of the responsiveness of the third torque control actuator can be performed independently, and thus the setting of the torque feedback circuit for exhibiting a required performance can be performed easily and accurately.

Further, since fluctuations in the delivery pressure of the second hydraulic pump are blocked by the pressure reduction valve and therefore do not influence the third torque control actuator when the delivery pressure of the second hydraulic pump is higher than the set pressure of the pressure reduction valve, the stability of the system is secured.

(3) In the above paragraph (1) or (2), preferably, the pressure limiting valve is a relief valve.

Effect of the Invention

According to the present invention, the absorption torque of the second hydraulic pump can be accurately detected by a purely hydraulic structure (torque feedback circuit). Besides, by feeding the absorption torque back to the side of the first hydraulic pump (the one hydraulic pump), it is possible to accurately perform the total torque control and to effectively utilize a rated output torque of the prime mover. In addition, since the absorption torque of the second hydraulic pump is detected on a purely hydraulic basis in this structure, the first pump control unit can be miniaturized, and mountability is enhanced. As a result, it is possible to provide a construction machine that is good in energy efficiency, low in fuel consumption, and is practical.

MODES FOR CARRYING OUT THE INVENTION

Figure 1A:
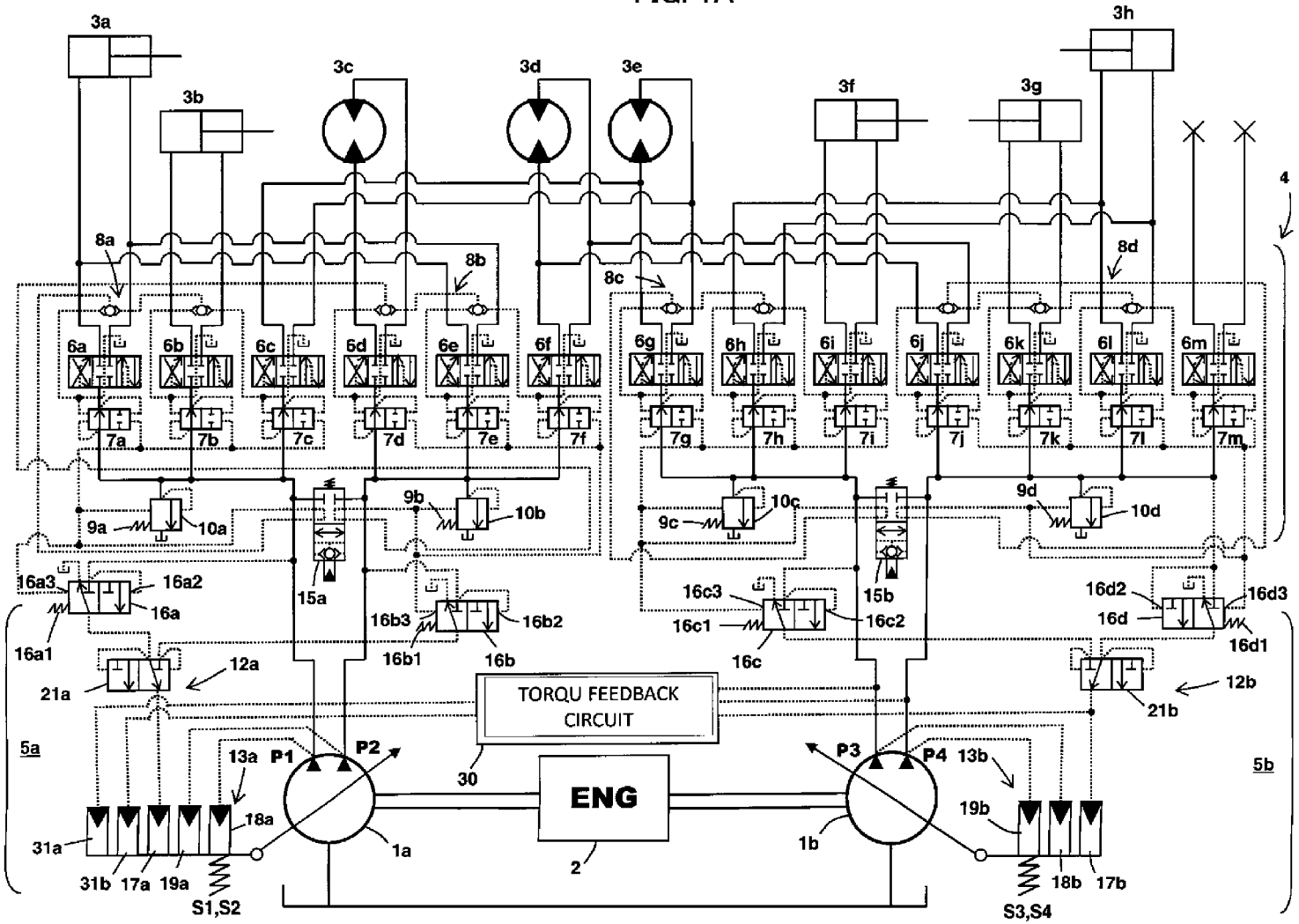
FIG. 1A is a hydraulic circuit diagram showing the whole part of a hydraulic drive system for a hydraulic excavator (construction machine) according to a first embodiment of the present invention.

Embodiments of the present invention will be described below, referring to the drawings.

—Structure—

Figure 1B:
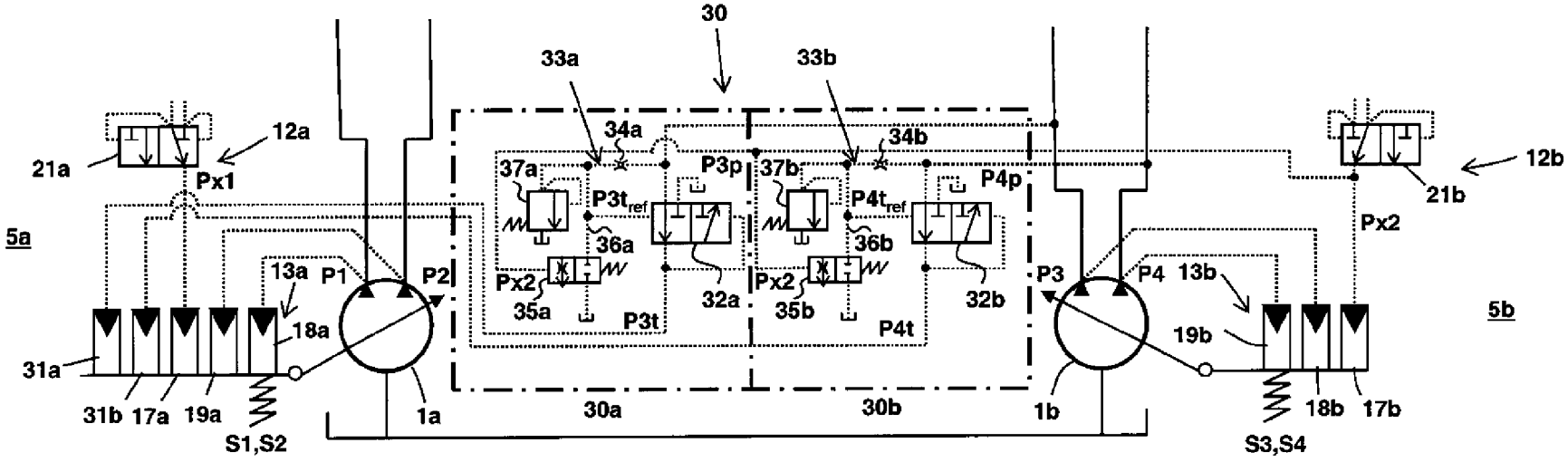
FIG. 1B is a hydraulic circuit diagram showing the details of a torque feedback circuit of the hydraulic drive system for the hydraulic excavator (construction machine) according to the first embodiment of the present invention.
Figure 2:
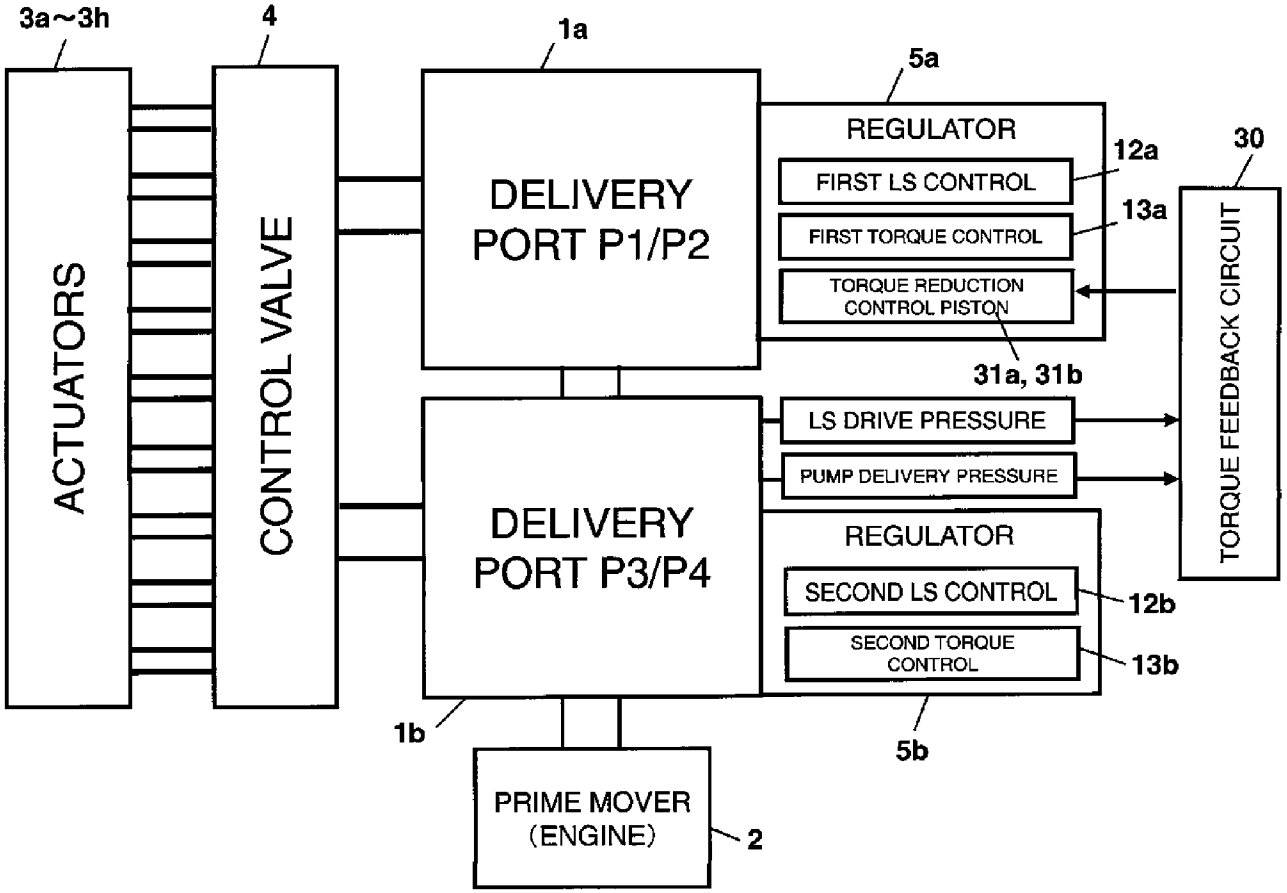
FIG. 2 is a block diagram showing the whole part of the hydraulic drive system for the hydraulic excavator (construction machine) according to the first embodiment of the present invention.

FIGS. 1A, 1B and 2 are diagrams showing a hydraulic drive system for a hydraulic excavator (construction machine) according to a first embodiment of the present invention. FIG. 1A is a hydraulic circuit diagram showing the whole of the hydraulic drive system, and FIG. 2 is a block diagram showing the whole of the hydraulic drive system. FIG. 1B is a hydraulic circuit diagram showing the details of a torque feedback circuit shown in FIGS. 1A and 2.

In FIGS. 1A and 2, the hydraulic drive system according to this embodiment includes: a variable displacement first hydraulic pump 1*a* having two delivery ports, namely, first and second delivery ports P1 and P2; a variable displacement second hydraulic pump 1*b* having two delivery ports, namely, third and fourth delivery ports P3 and P4; a prime mover 2 that is connected to the first and second hydraulic pumps 1*a* and 1*b* and drives the first and second hydraulic pumps 1*a* and 1*b*; a plurality of actuators 3*a* to 3*h* driven by hydraulic fluid delivered from the first and second delivery ports P1 and P2 of the first and second hydraulic pumps 1*a* and hydraulic fluid delivered from the third and fourth delivery ports P3 and P4 of the second hydraulic pump 1*b*; and a control valve 4 that is disposed between the first to fourth delivery ports P1 to P4 of the first and second hydraulic pumps 1*a* and 1*b* and the plurality of actuators 3*a* to 3*h* and controls flows of the hydraulic fluid supplied from the first to fourth delivery ports P1 to P4 of the first and second hydraulic pumps 1*a* and 1*b* to the plurality of actuators 3*a* to 3*h*.

The capacity of the first hydraulic pump 1*a* and the capacity of the second hydraulic pump 1*b* are the same. The capacity of the first hydraulic pump 1*a* and the capacity of the second hydraulic pump 1*b* may be different.

The first hydraulic pump 1*a* has a first pump control unit (regulator) 5*a* provided in common to the first and second delivery ports P1 and P2. Similarly, the second hydraulic pump 1*b* has a second pump control unit (regulator) 5*b* provided in common to the third and fourth delivery ports P3 and P4.

In addition, the first hydraulic pump 1*a* is a split flow type hydraulic pump provided with a single capacity control element (swash plate), and the first pump control unit 5*a* drives the single capacity control element to control the capacity (tilting angle of the swash plate) of the first hydraulic pump 1*a*, thereby controlling delivery flow rates of the first and second delivery ports P1 and P2. Similarly, the second hydraulic pump 1*b* is a split flow type hydraulic pump provided with a single capacity control element (swash plate), and the second pump control unit 5*b* drives the single capacity control element to control the capacity (tilting angle of the swash plate) of the second hydraulic pump 1*b*, thereby controlling delivery flow rates of the third and fourth delivery ports P3 and P4.

Each of the first and second hydraulic pumps 1*a* and 1*b* may be a combination of two variable displacement hydraulic pumps each having a single delivery port. In that case, the two capacity control elements (swash plates) of the two hydraulic pumps of the first hydraulic pump 1*a* may be driven by the first pump control unit 5*a*, and the two capacity control elements (swash plates) of the two hydraulic pumps of the second hydraulic pump 1*b* may be driven by the second pump control unit 5*b*.

The prime mover 2 is, for example, a diesel engine. As publicly known, a diesel engine has, for example, an electronic governor, which controls fuel injection amount, whereby revolution speed and torque are controlled. The engine resolution speed is set by operation means such as an engine control dial. The prime mover 2 may be an electric motor.

The control valve 4 includes: a plurality of closed center type flow control valves 6*a* to 6*m*; pressure compensating valves 7*a* to 7*m* that are connected to the upstream side of the flow control valves 6*a* to 6*m* and control differential pressures across meter-in restrictor parts of the flow control valves 6*a* to 6*m*; a first shuttle valve group 8*a* that is connected to load pressure ports of the flow control valves 6*a* to 6*c* and detects a maximum load pressure of the actuators 3*a*, 3*b* and 3*e*; a second shuttle valve group 8*b* that is connected to load pressure ports of the flow control valves 6*d* to 6*f* and detects a maximum load pressure of the actuators 3*a*, 3*c* and 3*d*; a third shuttle valve group 8*c* that is connected to load pressure ports of the flow control valves 6*g* to 6*i* and detects a maximum load pressure of the actuators 3*e*, 3*f* and 3*h*; a fourth shuttle valve group 8*d* that is connected to load pressure ports of the flow control valves 6*j* and 6*m* and detects a maximum load pressure of a spare actuator when the spare actuator is connected to the actuators 3*d*, 3*g* and 3*h* and the flow control valve 6*m*; first and second unloading valves 10*a* and 10*b* that are connected respectively to the delivery ports P1 and P2 of the first hydraulic pump 1*a*, and that are put into an open state when the delivery pressures of the delivery ports P1 and P2 become higher than pressures obtained by adding set pressures (unloading pressures) of springs 9*a* and 9*b* to the maximum load pressure detected by the first and second shuttle valve groups 8*a* and 8*b*, so that the hydraulic fluid from the delivery ports P1 and P2 is returned into a tank, thereby limiting a rise in the delivery pressures; third and fourth unloading valves 10*c* and 10*d* that are connected respectively to the delivery ports P3 and P4 of the second hydraulic pump 1*b*, and that are put into an open state when the delivery pressures of the delivery ports P3 and P4 become higher than pressures obtained by adding set pressures (unloading pressures) of springs 9*c* and 9*d* to the maximum load pressure detected by the third and fourth shuttle valve groups 8*c* and 8*d*, so that the hydraulic fluid from the delivery ports P3 and P4 is returned into a tank, thereby limiting a rise in the delivery pressures; a first communication control valve 15*a* disposed between respective delivery hydraulic lines of the first and second delivery ports P1 and P2 of the first hydraulic pump 1*a* and between respective output hydraulic lines of the first and second shuttle valve groups 8*a* and 8*b*; and a second communication control valve 15*b* disposed between respective delivery hydraulic lines of the third and fourth delivery ports P3 and P4 of the second hydraulic pump 1*b* and between respective output hydraulic lines of the third and fourth shuttle valve groups 8*c* and 8*d*. The set pressures of the springs 9*a* to 9*d* of the first to fourth unloading valves 10*a* to 10*d* are set to be equal to or slightly higher than a target differential pressure in a load sensing control described later.

Besides, though not shown in the drawings, the control valve 4 includes first and second main relief valves that are connected respectively to the delivery ports P1 and P2 of the first hydraulic pump 1*a* and function as safety valves, and third and fourth main relief valves that are connected respectively to the delivery ports P3 and P4 of the second hydraulic pump 1*b* and function as safety valves.

The pressure compensating valves 6*a* to 6*f* are configured such that differential pressures between the delivery pressures of the delivery ports P1 and P2 of the first hydraulic pump 1*a* and the maximum load pressure detected by the first and second shuttle valve groups 8*a* and 8*b* are set as target compensation pressures. The pressure compensating valves 7*g* to 7*m* are configured such that differential pressures between the delivery pressures of the delivery ports P3 and P4 of the second hydraulic pump 1*b* and the maximum load pressure detected by the third and fourth shuttle valve groups 8*c* and 8*d* are set as target compensation pressures. Specifically, the pressure compensating valves 7*a* to 7*c* perform such a control that the delivery pressure of the first delivery port P1 is introduced to an opening direction operation side, the maximum load pressure of the actuators 3*a* to 3*e* detected by the first and second shuttle valve groups 8*a* and 8*b* is introduced to a closing direction operation side, and differential pressures across the meter-in restrictor parts of the flow control valves 6*a* to 6*c* become equal to the differential pressure between the delivery pressure and the maximum load pressure. The pressure compensating valves 7*d* to 7*f* perform such a control that the delivery pressure of the second delivery port P2 is introduced to an opening direction operation side, the maximum load pressure of the actuators 3*a* to 3*e* detected by the first and second shuttle valve groups 8*a* and 8*b* is introduced to a closing direction operation side, and differential pressures across the meter-in restrictor arts of the flow control valves 6*d* to 6*f* become equal to the differential pressure between the delivery pressure and the maximum load pressure. The pressure compensating valves 7*g* to 7*i* perform such a control that the delivery pressure of the third delivery port P3 is introduced to an opening direction operation side, the maximum load pressure of the actuators 3*d* to 3*h* detected by the third and fourth shuttle valve groups 8*c* and 8*d* is introduced to a closing direction operation side, and differential pressures across the meter-in restrictor parts of the flow control valves 6*g* to 6*i* become equal to the differential pressure between the delivery pressure and the maximum load pressure. The pressure compensating valves 7*j* to 7*m* perform such a control that the delivery pressure of the fourth delivery port P4 is introduced to an opening direction operation side, the maximum load pressure of the actuators 3*d* to 3*h* detected by the third and fourth shuttle valve groups 8*c* and 8*d* is introduced to a closing direction operation side, and differential pressures across the meter-in restrictor parts of the flow control valves 6*j* to 6*m* become equal to the differential pressure between the delivery pressure and the maximum load pressure. This structure ensures that at the time of a combined operation of simultaneously driving the plurality of actuators respectively in the first hydraulic pump 1*a* and the second hydraulic pump 1*b*, a distribution of flow rates according to the opening area ratios of the flow control valves can be performed irrespectively of the magnitude of the load pressures of the actuators. In addition, even in a saturation state in which the delivery flow rates of the first to fourth delivery ports P1 to P4 are deficient, it is possible to reduce the differential pressures across the meter-in restrictor parts of the flow control valves according to the degree of saturation, and thereby to secure good properties for the combined operation.

The plurality of actuators 3*a* to 3*d* are, for example, an arm cylinder, a bucket cylinder, a swing cylinder, and a left travelling motor, respectively, of a hydraulic excavator. The plurality of actuators 3*e* to 3*h* are, for example, a right travelling motor, a swing cylinder, a blade cylinder, and a boom cylinder, respectively.

Here, the arm cylinder 3*a* is connected to the first and second delivery ports P1 and P2 through the flow control valves 6*a* and 6*e* and the pressure compensating valves 7*a* and 7*e* such that both the hydraulic fluids delivered from the first and second delivery ports P1 and P2 of the first hydraulic pump 1*a* are supplied in a joining manner. The boom cylinder 3*h* is connected to the third and fourth delivery ports P3 and P4 through the flow control valves 6*h* and 6*l* and the pressure compensating valves 7*h* and 7*l* such that both the hydraulic fluids delivered from the third and fourth delivery ports P3 and P4 of the second hydraulic pump 1*b* are supplied in a joining manner.

The travelling-left travelling motor 3*d* is connected to the second and fourth delivery ports P2 and P4 through the flow control valves 6*f* and 6*j* and the pressure compensating valves 7*f* and 7*j* such that the hydraulic fluid delivered from the second delivery port P2 as one delivery port of the first and second delivery ports P1 and P2 of the first hydraulic pump 1*a* and the hydraulic fluid delivered from the fourth delivery port P4 as one of the third and fourth delivery ports P3 and P4 of the second hydraulic pump 1*b* are supplied in a joining manner. The travelling-right travelling motor 3*e* is connected to the first and third delivery ports P1 and P3 through the flow control valves 6*c* and 6*g* and the pressure compensating valves 7*c* and 7*g* such that the hydraulic fluid delivered from the first delivery port P1 as the other delivery port of the first and second delivery ports P1 and P2 of the first hydraulic pump 1*a* and the hydraulic fluid delivered from the third delivery port P3 as the other delivery port of the third and fourth delivery ports P3 and P4 of the second hydraulic pump 1*b* are supplied in a joining manner.

Besides, the bucket cylinder 3*b* is connected to the first delivery port P1 of the first hydraulic pump 1*a* through the flow control valve 6*b* and the pressure compensating valve 7*b* so that the hydraulic fluid delivered from the first delivery port P1 is supplied to the bucket cylinder 3*b*. The swing motor 3*c* is connected to the second delivery port P2 of the first hydraulic pump 1*a* through the flow control valve 6*d* and the pressure compensating valve 7*d* so that the hydraulic fluid delivered from the second delivery port P2 is supplied to the swing motor 3*c*.

The swing cylinder 3*f* is connected to the third delivery port P3 of the second hydraulic pump 1*b* through the flow control valve 6*i* and the pressure compensating valve 7*i* so that the hydraulic fluid delivered from the third delivery port P3 is supplied to the swing cylinder 3*f*. The blade cylinder 3*g* is connected to the fourth delivery port P4 of the second hydraulic pump 1*b* through the flow control valve 6*k* and the pressure compensating valve 7*k* so that the hydraulic fluid delivered from the fourth delivery port P4 is supplied to the blade cylinder 3*g*.

The flow control valve 6*m* and the pressure compensating valve 7*m* are for use as spare (accessory); for example, in the case where the bucket 308 is replaced by a crusher, an opening/closing cylinder of the crusher is connected to the fourth delivery port P4 through the flow control valve 6*m* and the pressure compensating valve 7*m*.

The first communication control valve 15*a* is in an interruption position of the upper side in the drawing at the time other than the combined operation of simultaneously driving the travelling motors 3*d* and 3*e* and at least one of the other actuators (the boom cylinder 3*c*, the bucket cylinder 3*b*, and the swing motor 3*c*) concerning the first hydraulic pump 1*a* (hereinafter referred to as the time other than the travelling combined operation), and is changed over to a communication position of the lower side in the drawing at the time of the combined operation of simultaneously driving the travelling motors 3*d* and 3*e* and at least one of the other actuators (hereinafter referred to as the time of the travelling combined operation).

The second communication control valve 15*b* is in an interruption position of the upper side in the drawing at the time other than the combined operation of simultaneously driving the travelling motors 3*d* and 3*e* and at least one of the other actuators (the swing cylinder 3*f*, the blade cylinder 3*g*, and the boom cylinder 3*h*) concerning the second hydraulic pump 1*b* (hereinafter referred to as the time other than the travelling combined operation), and is changed over to a communication position of the lower side in the drawing at the time of the combined operation of simultaneously driving the travelling motors 3*d* and 3*e* and at least one of the other actuators (hereinafter referred to as the time of the travelling combined operation).

When the first communication control valve 15*a* is in the interruption position of the upper side in the drawing, it interrupts the communication between respective delivery hydraulic lines of the first and second delivery ports P1 and P2 of the first hydraulic pump 1*a*, and, when changed over to the communication position of the lower side in the drawing, the first communication control valve 15*a* causes the respective delivery hydraulic lines of the first and second delivery ports P1 and P2 of the first hydraulic pump 1*a* to communicate with each other.

Similarly, when the second communication control valve 15*b* in the interruption position of the upper side in the drawing, it interrupts the communication between respective delivery hydraulic lines of the third and fourth delivery ports P3 and P4 of the second hydraulic pump 1*b*, and, when changed over to the communication position of the lower side in the drawing, the second communication control valve 15*b* causes the respective delivery hydraulic lines of the third and fourth delivery ports P3 and P4 of the second hydraulic pump 1*b* to communicate with each other.

In addition, the first communication control valve 15*a* incorporates a shuttle valve therein. When in the interruption position of the upper side in the drawing, the first communication control valve 15*a* interrupts the communication between an output hydraulic line of the first shuttle valve group 8*a* and an output hydraulic line of the second shuttle valve group 8*b*, and causes the respective output hydraulic lines of the first and second shuttle valve groups 8*a* and 8*b* to communicate with the downstream side. When changed over to the communication position of the lower side in the drawing, the first communication control valve 15*a* causes the respective output hydraulic lines of the first and second shuttle valve groups 8*a* and 8*b* to communicate with each other through the shuttle valve, thereby to introduce a maximum load pressure on the high-pressure side to the downstream side.

Similarly, the second communication control valve 15*b* incorporates a shuttle valve therein. When in the interruption position of the upper side in the drawing, the second communication control valve 15*b* interrupts the communication between an output hydraulic line of the third shuttle valve group 8*c* and an output hydraulic line of the fourth shuttle valve group 8*d*, and causes the respective output hydraulic lines of the third and fourth shuttle valve groups 8*c* and 8*d* to communicate with the downstream side. When changed over to the communication position of the lower side in the drawing, the second communication control valve 15*b* causes the respective output hydraulic lines of the third and fourth shuttle valve groups 8*c* and 8*d* to communicate with each other through the shuttle valve, thereby to introduce a maximum load pressure on the high-pressure side to the downstream side.

When the first communication control valve 15*a* is in the interruption position of the upper side in the drawing, in the side of the first delivery port P1 of the first hydraulic pump 1*a*, the maximum load pressure of the actuators 3*a*, 3*b* and 3*e* detected by the first shuttle valve group 8*a* is introduced to the first unloading valve 10*a* and the pressure compensating valves 7*a* to 7*c*, so that based on the maximum load pressure, the first unloading valve 10*a* limits a rise in the delivery pressure of the first delivery port P1, and the pressure compensating valves 7*a* to 7*c* control the differential pressures across the meter-in restrictor parts of the flow control valves 6*a* to 6*c*. In the side of the second delivery port P2 of the second hydraulic pump 1*a*, the maximum load pressure of the actuators 3*a*, 3*c* and 3*d* detected by the second shuttle valve group 8*b* is introduced to the second unloading valve 10*b* and the pressure compensating valves 7*d* to 7*f*, so that based on the maximum load pressure, the second unloading valve 10*b* limits a rise in the delivery pressure of the second delivery port P2, and the pressure compensating valves 7*d* to 7*f* control the differential pressures across the meter-in restrictor parts of the flow control valves 6*d* to 6*f*.

When the first communication control valve 15*a* is changed over to the communication position of the lower side in the drawing, in the side of the first delivery port P1 of the first hydraulic pump 1*a*, the maximum load pressure of the actuators 3*a* to 3*e* detected by the first and second shuttle valve groups 8*a* and 8*b* is introduced to the first unloading valve 10*a* and the pressure compensating valves 7*a* to 7*c*, so that based on the maximum load pressure, the first unloading valve 10*a* limits a rise in the delivery pressure of the first delivery port P1, and the pressure compensating valves 7*a* to 7*c* control the differential pressures across the meter-in restrictor parts of the flow control valves 6*a* to 6*c*. Similarly, in the side of the second delivery port P2 of the second hydraulic pump 1*a*, the maximum load pressure of the actuators 3*a* to 3*e* detected by the first and second shuttle valve groups 8*a* and 8*b* is introduced to the second unloading valve 10*b* and the pressure compensating valves 7*d* to 7*f*, so that based on the maximum load pressure, the second unloading valve 10*b* limits a rise in the delivery pressure of the second delivery port P2, and the pressure compensating valves 7*d* to 7*f* control the differential pressures across the meter-in restrictor parts of the flow control valves 6*d* to 6*f*.

When the second communication control valve 15*b* is in the interruption position of the upper side in the drawing, in the side of the third delivery port P3 of the second hydraulic pump 1*b*, the maximum load pressure of the actuators 3*e*, 3*f* and 3*h* detected by the third shuttle valve group 8*c* is introduced to the third unloading valve 10*c* and the pressure compensating valves 7*g* to 7*i*, so that based on the maximum load pressure, the third unloading valve 10*c* limits a rise in the delivery pressure of the third delivery port P3, and the pressure compensating valves 7*g* to 7*i* control the differential pressures across the meter-in restrictor parts of the flow control valves 6*g* to 6*i*. In the side of the fourth delivery port P4 of the second hydraulic pump 1*b*, the maximum load pressure of the actuators 3*d*, 3*g* and 3*h* detected by the fourth shuttle valve group 8*d* is introduced to the fourth unloading vale 10*d* and the pressure compensating valves 7*j* to 7*m*, so that based on the maximum load pressure, the fourth unloading valve 10*d* limits a rise in the delivery pressure of the fourth delivery port P4, and the pressure compensating valves 7*j* to 7*m* control the differential pressures across the meter-in restrictor parts of the flow control valves 6*j* to 6*m*.

When the second communication control valve 15*b* is changed over to the communication position of the lower side in the drawing, in the side of the third delivery port P3 of the second hydraulic pump 1*b*, the maximum load pressure of the actuators 3*d* to 3*h* detected by the third and fourth shuttle valve groups 8*c* and 8*d* is introduced to the third unloading valve 10*c* and the pressure compensating valves 7*g* to 7*i*, so that based on the maximum load pressure, the third unloading valve 10*c* limits a rise in the delivery pressure of the third delivery port P3, and the pressure compensating valves 7*g* to 7*i* control the differential pressures across the meter-in restrictor parts of the flow control valves 6*g* to 6*i*. Similarly, in the side of the fourth delivery port P4 of the second hydraulic pump 1*b*, the maximum load pressure of the actuators 3*d* to 3*h* detected by the third and fourth shuttle valve groups 8*c* and 8*d* is introduced to the fourth unloading valve 10*d* and the pressure compensating valves 7*j* to 7*m*, so that based on the maximum load pressure, the fourth unloading valve 10*d* limits a rise in the delivery pressure of the fourth delivery port P4, and the pressure compensating valves 7*j* to 7*m* control the differential pressures across the meter-in restrictor parts of the flow control valves 6*j* to 6*m*.

The first pump control unit 5*a* includes: a first load sensing control section 12*a* for controlling the tilting angle of the swash plate (capacity) of the first hydraulic pump 1*a* in such a manner that the delivery pressures of the first and second delivery ports P1 and P2 of the hydraulic pump 1*a* become higher by a predetermined pressure than the maximum load pressure of the actuators 3*a* to 3*e* driven by the hydraulic fluids delivered from the first and second delivery ports P1 and P2 in the plurality of actuators 3*a* to 3*h*; and a first torque control section 13*a* for limiting and controlling the tilting angle of the swash plate (capacity) of the first hydraulic pump 1*a* in such a manner that the absorption torque of the first hydraulic pump 1*a* does not exceed a predetermined value.

The second pump control unit 5*b* includes: a second load sensing control section 12*b* for controlling the tilting angle of the swash plate (capacity) of the second hydraulic pump 1*b* in such a manner that the delivery pressures of the third and fourth delivery ports P3 and P4 of the second hydraulic pump 1*b* become higher by a predetermined angle than the maximum load pressure of the actuators 3*d* to 3*h* driven by the hydraulic fluids delivered from the third and fourth delivery ports P3 and P4 in the plurality of actuators 3*a* to 3*h*; and a second torque control section 13*b* for limiting and controlling the tilting angle of the swash plate (capacity) of the second hydraulic pump 1*b* in such a manner that the absorption torque of the second hydraulic pump 1*b* does not exceed a predetermined value.

The first load sensing control section 12*a* includes: load sensing control valves 16*a* and 16*b* for generating load sensing drive pressures (hereinafter referred to as LS drive pressures); a low pressure selection valve 21*a* for selecting and outputting the lower pressure side of the LS drive pressures generated by the load sensing control valves 16*a* and 16*b*; and a load sensing control piston (load sensing control actuator) 17*a* to which the LS drive pressure selected and outputted by the low pressure selection valve 21*a* is introduced and which varies the tilting angle of the swash plate of the first hydraulic pump 1*a* according to the LS drive pressure.

The second load sensing control section 12*b* includes: load sensing control valves 16*c* and 16*d* for generating load sensing drive pressures (hereinafter referred to as LS drive pressures); a low pressure selection valve 21*b* for selecting and outputting a lower pressure side of the LS drive pressures generated by the load sensing control valves 16*c* and 16*d*; and a load sensing control piston (load sensing control actuator) 17*b* to which the LS drive pressure selected and outputted by the low pressure selection valve 21*b* is introduced and which varies the tilting angle of the swash plate of the second hydraulic pump 1*b* according to the LS drive pressure.

In the first load sensing control section 12*a*, a control valve 16*a* includes: a spring 16*a*1 for setting a target differential pressure for a load sensing control; a pressure receiving part 16*a*2 which is located opposite to the spring 16*a*1 and to which the delivery pressure of the first delivery port P1 is introduced; and a pressure receiving part 16*a*3 located on the same side as the spring 16*a*1. When the first communication control valve 15*a* is in the interruption position of the upper side in the drawing, the maximum load pressure of the actuators 3*a*, 3*b* and 3*e* detected by the first shuttle valve group 8*a* is introduced to the pressure receiving part 16*a*3 of the control valve 16*a*. When the first communication control valve 15*a* is changed over to the communication position of the lower side in the drawing, the maximum load pressure of the actuators 3*a* to 3*e* detected by the first and second shuttle valve groups 8*a* and 8*b* is introduced to the pressure receiving part 16*a*3 of the control valve 16*a*. The control valve 16*a* is displaced according to the balance among the delivery pressure of the first delivery port P1 introduced to the pressure receiving part 16*a*2, the maximum load pressure of the actuators 3*a*, 3*b* and 3*e* or the actuators 3*a* to 3*e* introduced to the pressure receiving part 16*a*3, and a biasing force of the spring 16*a*1, thereby to vary the LS drive pressure.

In other words, when the delivery pressure of the first delivery port P1 introduced to the pressure receiving part 16*a*2 becomes higher than a pressure obtained by adding the target differential pressure (predetermined pressure) set by the spring 16*a*1 to the maximum load pressure introduced to the pressure receiving part 16*a*2, the control valve 16*a* is moved leftward in the drawing to cause its secondary port to communicate with a hydraulic fluid source (the first delivery port P1), thereby raising the LS drive pressure. When the delivery pressure on the high pressure side of the first delivery port P1 introduced to the pressure receiving part 16*a*2 becomes lower than a pressure obtained by adding the target differential pressure (predetermined pressure) set by the spring 16*a*1 to the maximum load pressure introduced to the pressure receiving part 16*a*2, the control valve 16*a* is moved rightward in the drawing to cause the secondary port to communicate with the tank, thereby lowering the LS drive pressure. The hydraulic fluid source that the secondary port communicates with when the control valve 16*a* is moved leftward in the drawing may be a pilot hydraulic fluid source that is formed in a delivery hydraulic line of a pilot pump and generates a fixed pilot pressure.

The control valve 16*b* includes: a spring 16*b*1 for setting a target differential pressure for a load sensing control; a pressure receiving part 16b2 which is located opposite to the spring 16b1 and to which the delivery pressure of the second delivery port P2 is introduced; and a pressure receiving part 16b3 located on the same side as the spring 16b1. When the first communication control valve 15a is situated in the interruption position of the upper side in the drawing, the maximum load pressure of the actuators 3a, 3c and 3d detected by the second shuttle valve group 8b is introduced to the pressure receiving part 16b3 of the control valve 16b. When the first communication control valve 15a is changed over to the communication position of the lower side in the drawing, the maximum load pressure of the actuators 3a to 3e detected by the first and second shuttle valve groups 8a and 8b is introduced to the pressure receiving part 16a3 of the control valve 16b. The control valve 16b is displaced according to the balance among the delivery pressure of the second delivery port P2 introduced to the pressure receiving part 16b2, the maximum load pressure of the actuators 3a, 3c and 3d or the actuators 3a to 3e introduced to the pressure receiving part 16b3, and the biasing force of the spring 16b1, thereby varying the LS drive pressure, like the control valve 16a.

The low pressure selection valve 21a selects the lower pressure side of the LS drive pressures generated by the load sensing control valves 16a and 16b, and outputs the selected LS drive pressure to the load sensing control piston 17a. Based on the LS drive pressure, the load sensing control piston 17a varies the tilting angle of the swash plate of the first hydraulic pump 1a, and thereby varies the delivery flow rates of the first and second delivery ports P1 and P2.

In the second load sensing control section 12b, the control valve 16c includes: a spring 16c1 for setting a target differential pressure for a load sensing control; a pressure receiving part 16c2 which is located opposite to the spring 16c1 and to which the delivery pressure of the third delivery port P3 is introduced; and a pressure receiving part 16c3 located on the same side as the spring 16c1. When the second communication control valve 15b is located in the interruption position of the upper side in the drawing, the maximum load pressure of the actuators 3e, 3f and 3h detected by the third shuttle valve group 8c is introduced to the pressure receiving part 16c3 of the control valve 16c. When the second communication control valve 15b is changed over to the communication position of the lower side in the drawing, the maximum load pressure of the actuators 3d to 3h detected by the third and fourth shuttle valve groups 8c and 8d is introduced to the pressure receiving part 16c3 of the control valve 16c. The control valve 16c is displaced according to the balance among the delivery pressure of the third delivery port P3 introduced to the pressure receiving part 16c2, the maximum load pressure of the actuators 3e, 3f and 3h or the actuators 3d to 3h introduced to the pressure receiving part 16c3, and a biasing force of the spring 16c1, thereby varying the LS drive pressure, like the control valve 16a.

The control valve 16d includes: a spring 16d1 for setting a target differential pressure for a load sensing control; a pressure receiving part 16d2 which is located opposite to the spring 16d1 and to which the delivery pressure of the fourth delivery port P4 is introduced; and a pressure receiving part 16d located on the same side as the spring 16d1. When the second communication control valve 15b is located in the interruption position of the upper side in the drawing, the maximum load pressure of the actuators 3d, 3g and 3h detected by the fourth shuttle valve group 8d is introduced to the pressure receiving part 16d3 of the control valve 16d. When the second communication control valve 15b is changed over to the communication position of the lower side in the drawing, the maximum load pressure of the actuators 3d to 3h detected by the third and fourth shuttle valve groups 8c and 8d is introduced to the pressure receiving part 16d3 of the control valve 16d. The control valve 16d is displaced according to the balance among the delivery pressure of the fourth delivery port P4 introduced to the pressure receiving part 16d2, the maximum load pressure of the actuators 3d, 3g and 3h or the actuators 3d to 3h introduced to the pressure receiving part 16d3, and a biasing force of the spring 16d1, thereby varying the LS drive pressure, like the control valve 16a.

The low pressure selection valve 21b selects the lower pressure side of the LS drive pressures generated by the load sensing control valves 16c and 16d, and outputs the selected LS drive pressure to the load sensing control piston 17b. Based on the LS drive pressure, the load sensing control piston 17b varies the tilting angle of the swash plate of the second hydraulic pump 1b, and thereby varies the delivery flow rates of the third and fourth delivery ports P3 and P4.

Figure 3:
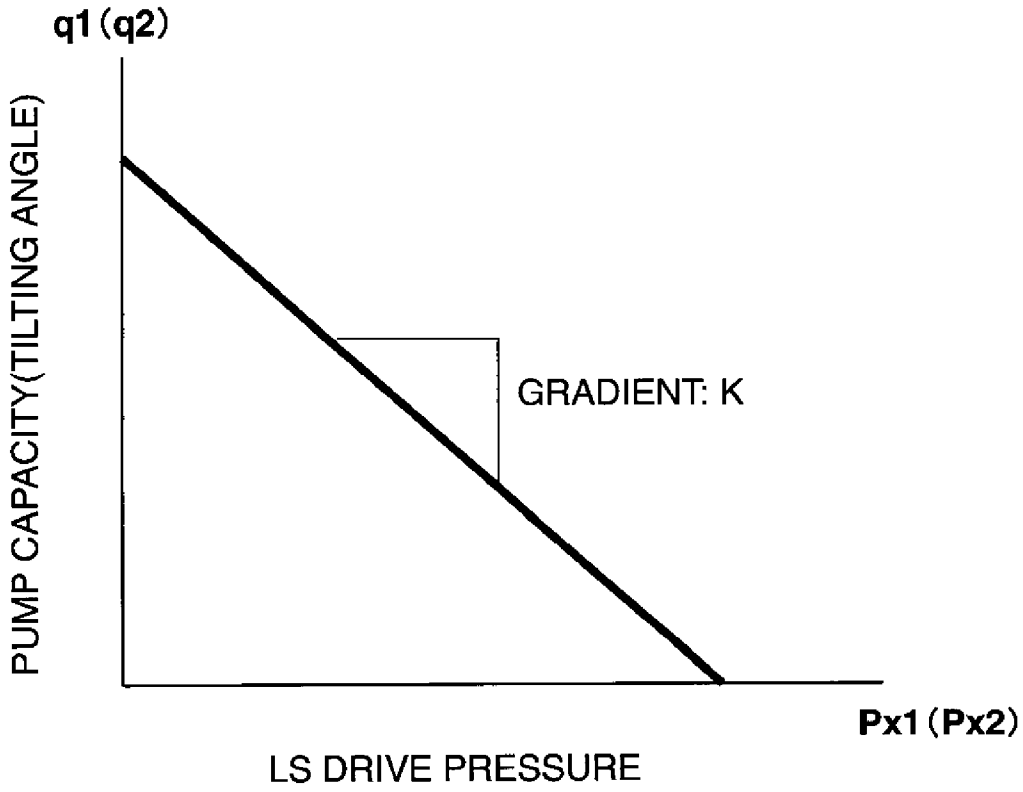
FIG. 3 is a diagram showing the relation between LS drive pressure and tilting angle of swash plate of first and second hydraulic pumps when a load sensing control piston operates.

FIG. 3 is a diagram showing the relation between LS drive pressures and tilting angles of swash plates of the first and second hydraulic pumps 1a and 1b when the load sensing control pistons 17a and 17b operate. In the diagram, the LS drive pressures acting on the load sensing control pistons 17a and 17b are denoted by Px1 and px2 , and the tilting angles of the swash plates of the first and second hydraulic pumps 1a and 1b are denoted by q1 and q2.

As shown in FIG. 3, when the LS drive pressure Px1 rises, the load sensing control piston 17a reduces the tilting angle q1 of the swash plate of the first hydraulic pump 1a, thereby decreasing the delivery flow rates of the first and second delivery ports P1 and P2. When the LS drive pressure Px1 is lowered, the load sensing control piston 17a enlarges the tilting angle q1 of the swash plate of the first hydraulic pump 1a, thereby increasing the delivery flow rates of the first and second delivery ports P1 and P2. With such arrangement, the first load sensing control section 12a controls the tilting angle of the swash plate (capacity) of the first hydraulic pump 1a in such a manner that the delivery pressure on the high pressure side of the first and second delivery ports P1 and P2 of the first hydraulic pump 1a becomes higher by a predetermined pressure than the maximum load pressure of the actuators 3a to 3e driven by the hydraulic fluids delivered from the first and second delivery ports P1 and P2. In the diagram, K is the rate of change of the tilting angle q1 of the swash plate of the first hydraulic pump 1a in relation to the LS drive pressure Px1, and is a value determined by the relation between constants of springs S3 and S4 described later and the tilting angle q2 (capacity) of the second hydraulic pump 1b.

Like the load sensing control piston 17a, the load sensing control piston 17b varies the tilting angle q2 of the swash plate of the second hydraulic pump 1b in accordance with variation in the LS drive pressure Px2, thereby to control the tilting angle of the swash plate (capacity) of the second hydraulic pump 1b in such a manner that the delivery pressure on the high pressure side of the third and fourth delivery ports P3 and P4 of the second hydraulic pump 1b becomes higher by a predetermined pressure than the maximum load pressure of the actuators 3d to 3h driven by the hydraulic fluids delivered from the third and fourth delivery ports P3 and P4.

In the first and second load sensing control sections 12 and 12b, the target differential pressures for the load sensing control that are set by the springs 16a1 and 16b1 and the springs 16c1 and 16d1 are each, for example, about 2 MPa.

Besides, in the first pump control unit 5a, the first torque control section 13a includes: a first torque control piston (first torque control actuator) 18a to which the delivery pressure of the first delivery port P1 is introduced; a second torque control piston (first torque control actuator) 19a to which the delivery pressure of the second delivery port P2 is introduced; and springs S1 and S2 (in FIG. 1, only one spring is illustrated for simplification) as biasing means for setting a maximum torque T1max (first maximum torque).

The second torque control section 13b includes: a third torque control piston (second torque control actuator) 18b to which the delivery pressure of the third delivery port P3 is introduced; a fourth torque control piston (second torque control actuator) 19b to which the delivery pressure of the fourth delivery port P4 is introduced; and springs S3 and S4 (in FIG. 1, only one spring is illustrated for simplification) as biasing means for setting a maximum torque T2max (second maximum torque).

In addition, the first torque control section 13a includes: a torque feedback circuit 30 to which the delivery pressures of the third and fourth delivery ports P3 and P4 of the second hydraulic pump 1b and the LS drive pressure acting on the load sensing control piston 17b of the second load sensing control section 12b are introduced, which modifies the delivery pressures of the third and fourth delivery ports P3 and P4 of the second hydraulic pump 1b based on the delivery pressures of the third and fourth delivery ports P3 and P4 and the LS drive pressure to provide a characteristic simulating the absorption torque of the second hydraulic pump 1b both in the cases of when the second hydraulic pump 1b is limited by control of the second torque control section 13b and operates at the maximum torque T2max (second maximum torque) and when the second hydraulic pump 1b is not limited by the control of the second torque control section 13b and the second load sensing control section 12b controls the capacity of the second hydraulic pump 1b (when lower than a starting pressure Pb of an absorption torque constant control of the second hydraulic pump 1b described later), and which outputs the modified pressures; a first torque reduction control piston (third torque control actuator) 31a to which an output pressure of the torque feedback circuit 30 obtained by modification of the delivery pressure of the third delivery port P3 of the second hydraulic pump 1b is introduced, and which, as the output pressure rises, decreases the tilting angle of swash plate (capacity) of the first hydraulic pump 1a and decreases the maximum torque T1max set by the springs S1 and S2; and a second torque reduction control piston (third torque control actuator) 31b to which an output pressure of the torque feedback circuit 30 obtained by modification of the delivery pressure of the fourth delivery port P4 of the second hydraulic pump 1b is introduced, and which, as the output pressure rises, decreases the tilting angle of swash plate (capacity) of the first hydraulic pump 1a and decreases the maximum torque T1max set by the springs S1 and S2.

Figure 4A:
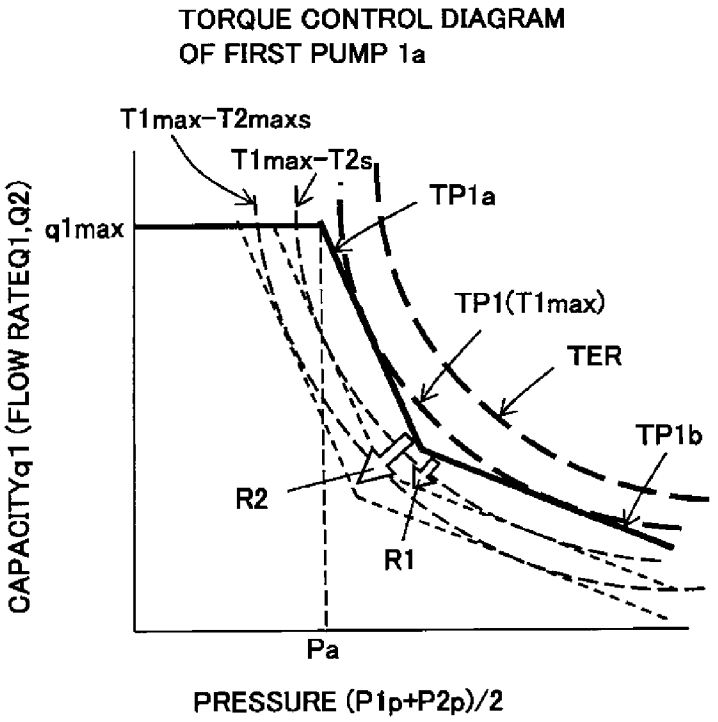
FIG. 4A is a torque control diagram of a first torque control section.
Figure 4B:
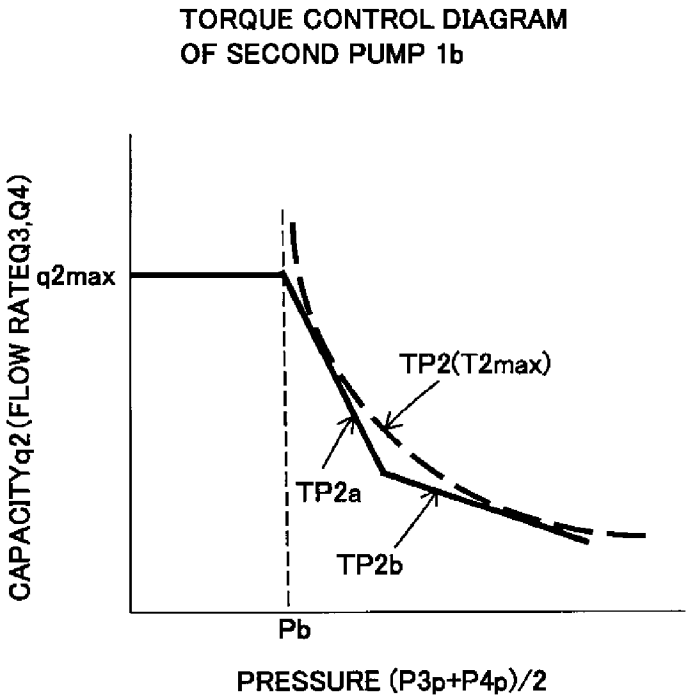
FIG. 4B is a torque control diagram of a second torque control section 13*b*.

FIG. 4A is a torque control diagram for the first torque control section 13a, and FIG. 4B is a torque control diagram for the second torque control section 13b. In these torque control diagrams, the axis of ordinates represents the tilting angle (capacity) q1, q2, and these diagrams are turned to be horsepower control diagrams when the axis of ordinates is replaced by delivery flow rate Q1, Q2 or delivery flow rate Q3, Q4. Besides, the axis of abscissas represents pump delivery pressure; specifically, the axis of abscissas represents average delivery pressure (P1p+P2p/2) of the first and second delivery ports P1 and P2 in FIG. 4A, and represents average delivery pressure (P3p+P 4p/2 ) of the third and fourth delivery ports P3 and P4 in FIG. 4B.

In FIG. 4A, when the hydraulic oil delivered by the second hydraulic pump 1b is not supplied to the actuators 3d to 3h, the torque feedback circuit 30 and the first and second torque reduction control pistons 31a and 31b do not function, and the maximum torque T1max is set in the first torque control section 13a by the springs S1 and S2. TP1 a and TP1b are characteristic curves of the springs S1 and S2 for setting the maximum torque T1max.

In this condition, when the hydraulic fluid delivered by the first hydraulic pump 1a is supplied to one of the actuators 3a to 3e concerning the first hydraulic pump 1a and the average delivery pressure of the first and second delivery ports P1 and P2 rises, the first torque control section 13a does not operate during when the average delivery pressure is not more than a pressure (torque control start pressure) Pa at a starting end of the characteristic curve TP1a. In this case, the tilting angle of swash plate (capacity) q1 of the first hydraulic pump 1a is not limited by the control of the first torque control section 13a, and can be increased to the maximum tilting angle q1max possessed by the first hydraulic pump 1a according to an operation amount of a control lever device (demanded flow rate), under the control of the first load sensing control section 12a.

When the average delivery pressure of the first and second delivery ports P1 and P2 exceeds Pa in a condition where the swash plate of the first hydraulic pump 1a is at the maximum tilting angle q1max, the first torque control section 13a operates to perform an absorption torque constant control (or horsepower constant control) so as to decrease the maximum tilting angle (maximum capacity) of the first hydraulic pump 1a along the characteristic curves TP1a and TP1b as the average delivery pressure rises. In this case, the first load sensing control section 12a cannot increase the tilting angle of the first hydraulic pump 1a in excess of a tilting angle determined by the characteristic curves TP1a and TP1b.

As shown in the diagram, the characteristic curves TP1a and TP1 b are set to be approximate to an absorption torque constant curve (hyperbola) TP1 by the two springs S1 and S2. With such setting, the first torque control section 13a performs the absorption torque constant control (or horsepower constant control) such that the absorption torque of the first hydraulic pump 1a does not exceed the maximum torque T1max when the average delivery pressure of the first hydraulic pump 1a rises. The maximum torque T1max is set to be slightly lower than a rated output torque TER of an engine 2.

In FIG. 4B, a maximum torque T2max is set in the second torque control section 13b by the springs S3 and S4, irrespectively of the operating conditions of the first hydraulic pump 1a. TP2a and TP2b are characteristic curves of the springs S3 and S4 for setting the maximum torque T1max.

When the hydraulic fluid delivered by the second hydraulic pump 1b is supplied to one of the actuators 3d to 3h concerning the second hydraulic pump 1b and the average delivery pressure of the third and fourth delivery ports P3 and P4 rises, the second torque control section 13b does not operate while the average delivery pressure is not more than a pressure (torque control start pressure) Pb at a starting end of the characteristic curve TP2a. In this case, the tilting angle of swash plate (capacity) q2 of the second hydraulic pump 1b is not limited by control of the second torque control section 13b, and the tilting angle can be increased to a maximum tilting angle q2max possessed by the second hydraulic pump 1b according to an operation amount of the control lever device (demanded flow rate), under control of the second load sensing control section 12*b*.

When the average delivery pressure of the third and fourth delivery ports P3 and P4 exceeds Pb in a condition where the swash plate of the second hydraulic pump 1*b* is at the maximum tilting angle q2max, the second torque control section 13*b* operates to perform an absorption torque constant control so as to decrease the maximum tilting angle (maximum capacity) of the second hydraulic pump 1*b* along the characteristic curves TP2a and TP2b as the average delivery pressure rises. In this case, the second load sensing control section 12*b* cannot increase the tilting angle of the second hydraulic pump 1*b* in excess of a tilting angle determined by the characteristic curves TP2a and TP2b.

As shown in the diagram, the characteristic curves TP2a and TP2b are set to be approximate to an absorption torque constant curve (hyperbola) TP2 by the two springs S3 and S4. With such setting, the second torque control section 13*b* performs an absorption torque constant control (or horsepower constant control) such that the absorption torque of the second hydraulic pump 1*b* does not exceed the maximum torque T2max when the average delivery pressure of the second hydraulic pump 1*b* rises. The maximum torque T2max is lower than the maximum torque T1max set in the first torque control section 13*a*, and is set to be about ½ times the rated output torque TER of the engine 2.

In addition, when the hydraulic fluid delivered by the second hydraulic pump 1*b* is supplied to one of the actuators 3*d* to 3*h* concerning the second hydraulic pump 1*b* and the one of the actuators 3*d* to 3*h* is driven by the hydraulic fluid delivered by the second hydraulic pump 1*b*, the torque feedback circuit 30 modifies the delivery pressures of the third and fourth delivery ports P3 and P4 of the second hydraulic pump 1*b* so as to attain a characteristic simulating the absorption torque of the second hydraulic pump 1*b*, and outputs the modified delivery pressures. In addition, the first and second torque reduction control pistons 31*a* and 31*b* decrease the maximum torque T1max set in the first torque control section 13*a* as the output pressure of the torque feedback circuit 30 rises.

In FIG. 4A, the two arrows R1 and R2 represent the effects of the first and second torque reduction control pistons 31*a* and 31*b* to decrease the maximum torque T1max. When the delivery pressures of the third and fourth delivery ports P3 and P4 of the second hydraulic pump 1*b* rise and when the absorption torque of the second hydraulic pump 1*b* in that instance is T2 which is lower than the maximum torque T2max and the absorption torque simulated by the torque feedback circuit 30 is T2s (≈T2max), the torque feedback pistons 32*a* and 32*b* decrease the maximum torque T1max to T1max−T2s, as indicated by the arrow R1 in FIG. 4A. In addition, when the absorption torque of the second hydraulic pump 1*b* is the maximum torque T2max and the absorption torque simulated by the torque feedback circuit 30 is T2maxs (≈T2max), the torque feedback pistons 32*a* and 32*b* decrease the maximum torque T1max to T1max−T2maxs, as indicated by the arrow R2 in FIG. 4A.

Here, the maximum torque T1max set in the first torque control section 13*a* is lower than the rated output torque TER of the engine 2, as aforementioned. In addition, when the hydraulic fluid delivered by the second hydraulic pump 1*b* is not supplied to the actuators 3*d* to 3*h* and the hydraulic fluid delivered by the first hydraulic pump 1*a* is supplied to one of the actuators 3*a* to 3*e* to drive the one of the actuators 3*a* to 3*e*, the first torque control section 13*a* performs an absorption torque constant control (or horsepower constant control) such that the absorption torque of the first hydraulic pump 1*a* does not exceed the maximum torque T1max, whereby the absorption torque of the first hydraulic pump 1*a* is controlled not to exceed the rated output torque TER of the engine 2. With such arrangement, stoppage of the engine 2 (engine stall) can be prevented, while making the most of the rated output torque TER of the engine 2.

In addition, when the hydraulic fluid delivered by the second hydraulic pump 1*b* is supplied to one of the actuators 3*d* to 3*h* and the one of the actuators 3*d* to 3*h* is driven by the hydraulic fluid delivered by the second hydraulic pump 1*b*, the torque feedback pistons 32*a* and 32*b* decrease the maximum torque T1max to T1max−T2s or T1max−T2maxs, as indicated by the arrow X in FIG. 4A, as aforementioned. With such arrangement, also in a combined operation of simultaneously driving one of the actuators 3*a* to 3*e* concerning the first hydraulic pump 1*a* and one of the actuators 3*d* to 3*h* concerning the second hydraulic pump 1*b*, a total torque control is conducted such that the total absorption torque of the first hydraulic pump 1*a* and the second hydraulic pump 1*b* does not exceed the rated output torque TER of the engine 2. In this case, also, stoppage of the engine 2 (engine stall) can be prevented, while making the most of the rated output torque TER of the engine 2.

FIG. 1B is a diagram showing the details of the torque feedback circuit 30.

The torque feedback circuit 30 includes: a first torque feedback circuit section 30*a* that modifies the delivery pressure of the third delivery port P3 of the second hydraulic pump 1*b* so as to attain a characteristic simulating the absorption torque of the second hydraulic pump 1*b*, and outputs the modified delivery pressure; and a second torque feedback circuit section 30*b* that modifies the delivery pressure of the fourth delivery port P4 of the second hydraulic pump 1*b* so as to attain a characteristic simulating the absorption torque of the second hydraulic pump 1*b*, and outputs the modified delivery pressure.

The first torque feedback circuit section 30*a* includes: a first torque pressure reduction valve 32*a* to which the delivery pressure of the third delivery port P3 is introduced; and a first pressure dividing circuit 33*a* that generates a target control pressure for setting a set pressure of the first torque pressure reduction valve 32*a*. When the delivery pressure of the third delivery port P3 is lower than the set pressure, the first torque pressure reduction valve 32*a* outputs the delivery pressure of the third delivery port P3 as a secondary pressure without reduction, whereas when the delivery pressure of the third delivery port P3 is higher than the set pressure, the first torque pressure reduction valve 32*a* reduces the delivery pressure of the third delivery port P3 to the set pressure (target control pressure) and outputs the thus reduced pressure. The output pressure (secondary pressure) is introduced to the first torque reduction control piston 31*a* as a torque control pressure.

The first pressure dividing circuit 33*a* includes: a first pressure dividing restrictor part 34*a* to which the delivery pressure of the third delivery port P3 is introduced; a first pressure dividing valve 35*a* located on a downstream side of the first pressure dividing restrictor part 34*a*; and a first relief valve (pressure limiting valve) 37*a* that is connected to a first hydraulic line 36*a* between the first pressure dividing restrictor part 34*a* and the first pressure dividing valve 35*a* and causes the pressure in the first hydraulic line 36*a* not to increase beyond a set pressure (relief pressure). The first pressure dividing restrictor part 34*a* is a fixed restrictor, and has a fixed opening area. The first pressure dividing valve 35*a* is a variable restrictor valve to which an LS drive pressure Px2 acting on the load sensing control piston 17*b* of the second load sensing control section 12*b* is introduced and which varies the opening area according to the LS drive pressure Px2. When the LS drive pressure Px2 is a tank pressure, the opening area of the first pressure dividing valve 35*a* is zero (fully closed). As the LS drive pressure Px2 rises, the opening area of the first pressure dividing valve 35*a* increases. When the LS drive pressure Px2 rises to be equal to or higher than a predetermined pressure, the opening area of the first pressure dividing valve 35*a* becomes maximum (fully opened). The target control pressure generated in the first hydraulic line 36*a* between the first pressure dividing restrictor 34*a* and the first pressure dividing valve 35*a* according to the variation in the opening area of the first pressure dividing valve 35*a* varies continuously from the set pressure of the first relief valve 37*a* to the tank pressure (zero). According to the variation in the target control pressure, a torque control pressure generated by the first torque pressure reduction valve 32*a* is also varied continuously. The set pressure of the first relief valve 37*a* is set to be equal to a torque control start pressure Pb (FIG. 4B) of the second torque control section 13*b*, in conformity with Pb.

The second torque feedback circuit section 30*b* also is configured similarly to the first torque feedback circuit section 30*a*. Specifically, the second torque feedback circuit section 30*b* includes: a second torque pressure reduction valve 32*b* to which the delivery pressure of the fourth delivery port P4 is introduced as a primary pressure; and a second pressure dividing circuit 33*b* that generates a target control pressure for providing a set pressure of the second torque pressure reduction valve 32*b*. When the delivery pressure of the fourth delivery port P4 is lower than the set pressure, the second torque pressure reduction valve 32*b* outputs the delivery pressure of the fourth delivery port P4 as a secondary pressure without reduction. When the delivery pressure of the fourth delivery port P4 is higher than the set pressure, the second torque pressure reduction valve 32*b* reduces the delivery pressure of the fourth delivery port P4 to the set pressure (target control pressure), and outputs the reduced pressure. The output pressure (secondary pressure) is introduced to the second torque reduction control piston 31*b* as a torque control pressure.

The second pressure dividing circuit 33*b* includes: a second pressure dividing restrictor part 34*b* to which the delivery pressure of the fourth delivery port P4 is introduced; a second pressure dividing valve 35*b* located on a downstream side of the second pressure dividing restrictor part 34*b*; and a second relief valve (pressure limiting valve) 37*b* that is connected to a second hydraulic line 36*b* between the second pressure dividing restrictor part 34*b* and the second pressure dividing valve 35*b* and causes the pressure in the second hydraulic line 36*b* not to increase beyond a set pressure (relief pressure). The second pressure dividing restrictor part 34*b* is a fixed restrictor, and has a fixed opening area. The second pressure dividing valve 35*b* is a variable restrictor valve to which the LS drive pressure Px2 acting on the load sensing control piston 17*b* of the second load sensing control section 12*b* is introduced, and which varies the opening area according to the LS drive pressure Px2. When the LS drive pressure Px2 is the tank pressure, the opening area of the first pressure dividing valve 35*a* is zero (fully closed). As the LS drive pressure Px2 rises, the opening area of the first pressure dividing valve 35*a* increases. When the LS drive pressure Px2 rises to be equal to or higher than a predetermined pressure, the opening area of the first pressure dividing valve 35*a* becomes maximum (fully opened). A target control pressure generated in the second hydraulic line 36*b* between the second pressure dividing restrictor 34*b* and the second pressure dividing valve 35*b* according to the variation in the opening area of the second pressure dividing valve 35*b* varies continuously from the set pressure of the second relief valve 37*b* to the tank pressure (zero). According to the variation in the target control pressure, a torque control pressure generated by the second torque pressure reduction valve 32*b* is also varied continuously. The set pressure of the second relief valve 37*b* is set to be equal to a torque control start pressure Pb (FIG. 4B) of the second torque control section 13*b*, in conformity with Pb.

Figure 5B:
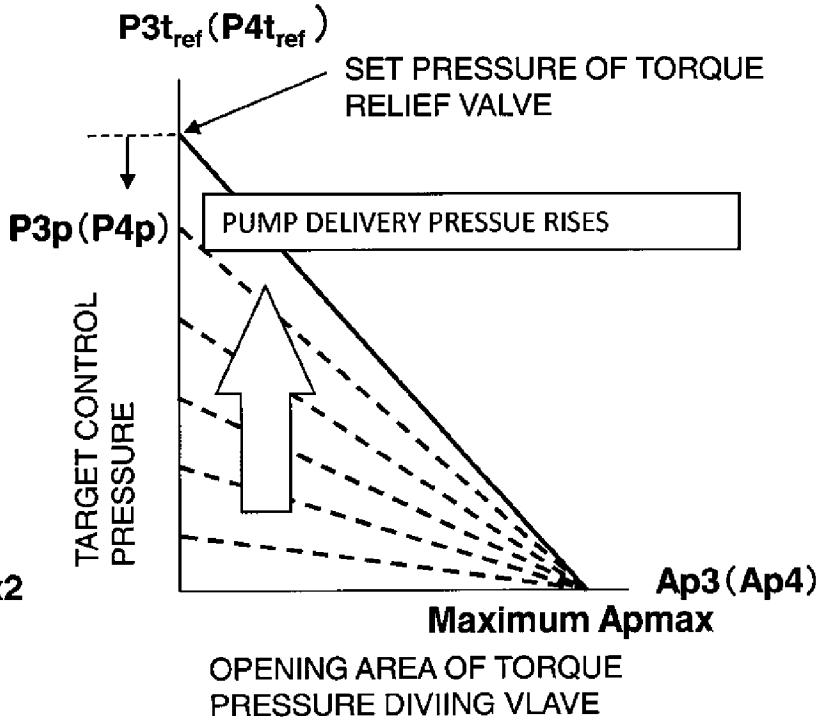
FIG. 5B is a diagram showing the relation between opening area of the first and second pressure dividing valves and target control pressure.
Figure 5A:
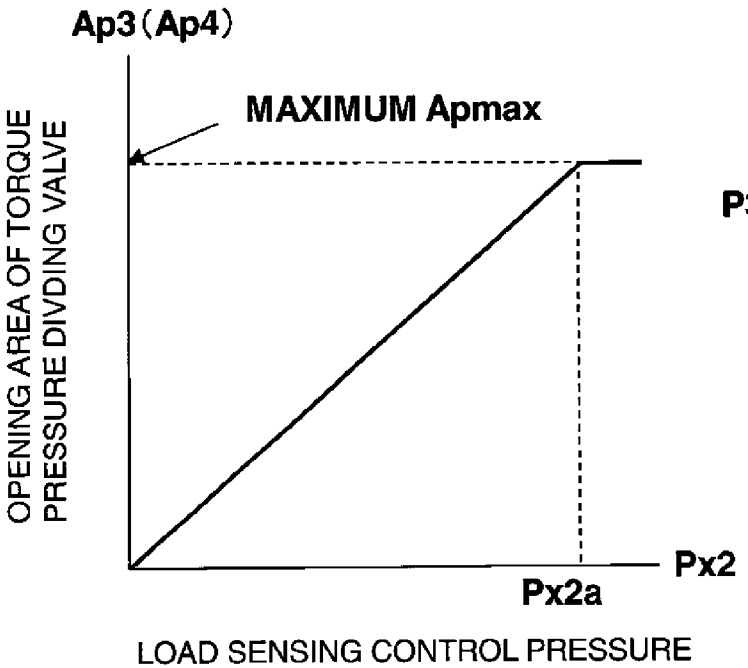
FIG. 5A is a diagram showing the relation between LS drive pressure and opening area of first and second pressure dividing valves.
Figure 5C:
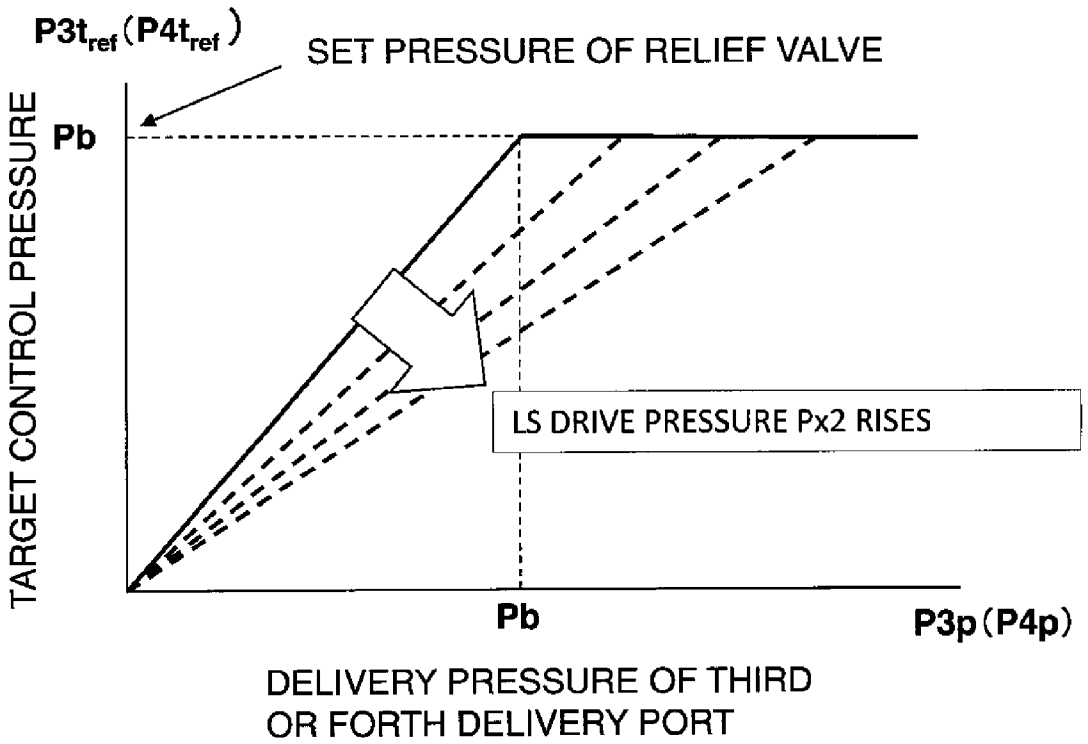
FIG. 5C is a diagram showing the relation between delivery pressure of third and fourth delivery ports and target control pressure when the LS drive pressure varies.
Figure 5D:
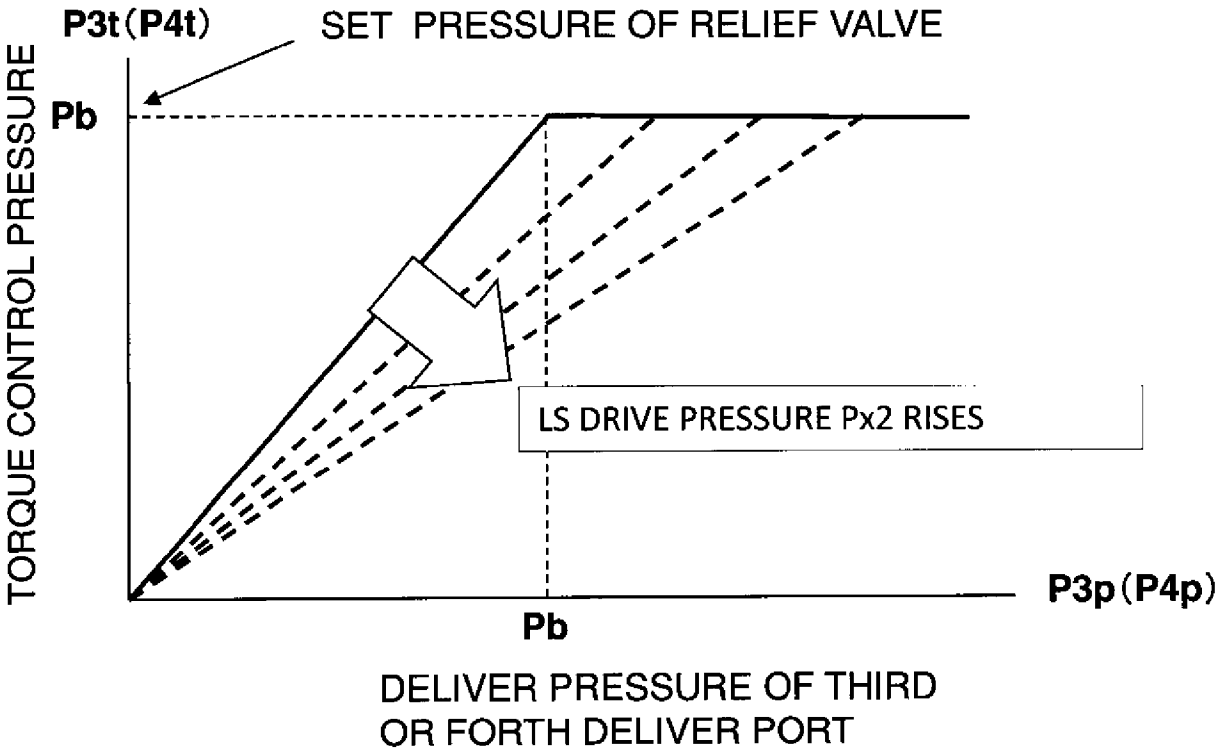
FIG. 5D is a diagram showing the relation between the delivery pressure of the third and fourth delivery ports and torque control pressure when the LS drive pressure varies.

FIG. 5A is a diagram showing the relation between the LS drive pressure Px2 and the opening area of the first and second pressure dividing valves 35*a* and 35*b*; FIG. 5B is a diagram showing the relation between the opening area of the first and second pressure dividing valves 35*a* and 35*b* and a target control pressure; FIG. 5C is a diagram showing the relation between the delivery pressure of the third and fourth delivery ports and the target control pressure when the LS drive pressure Px2 varies; and FIG. 5D is a diagram showing the relation between the delivery pressure of the third and fourth delivery ports and a torque control pressure when the LS drive pressure Px2 varies. In the diagrams, AP3 and AP4 are opening areas of the first and second pressure dividing valves 35*a* and 35*b*; P3tref and P4tref are the target control pressures generated in the first and second hydraulic lines 36*a* and 36*b*; P3p and P4p are delivery pressures of the third and fourth delivery ports; and P3t and P4t are the torque control pressures generated by the first and second torque pressure reduction valves 32*a* and 32*b*.

As shown in FIG. 5A, when the LS drive pressure Px2 acting on the load sensing control piston 17*b* of the second load sensing control section 12*b* is the tank pressure, the opening areas AP3 and AP4 of the first and second pressure dividing valves 35*a* and 35*b* are zero (fully closed). As the LS drive pressure Px2 rises, the opening areas AP3 and AP4 of the first and second pressure dividing valves 35*a* and 35*b* increase. When the LS drive pressure Px2 rises to be equal to or higher than a predetermined pressure Px2a, the opening areas of the first and second pressure dividing valves 35*a* and 35*b* become maximum (fully opened).

As shown in FIG. 5B, when the opening areas AP3 and AP4 of the first and second pressure dividing valves 35*a* and 35*b* are zero (fully closed), the pressures in the first and second hydraulic lines 36*a* and 36*b* are equal to the delivery pressures P3p and P4p of the third and fourth delivery ports. It is to be noted, however, that the pressures in the first and second hydraulic lines 36*a* and 36*b* cannot become equal to or higher than the set pressures of the first and second relief valves 37*a* and 37*b*. As the opening areas AP3 and AP4 of the first and second pressure dividing valves 35*a* and 35*b* increase from the zero (fully closed), the target control pressures P3tref and P4tref are lowered. When the opening areas AP3 and AP4 of the first and second pressure dividing valves 35*a* and 35*b* become maximum APmax (fully opened), the target control pressures P3tref and P4tref become the tank pressure (zero).

As shown in FIG. 5C, when the LS drive pressure is the tank pressure (zero), the opening areas AP3 and AP4 of the first and second pressure dividing valves 35*a* and 35*b* are zero (fully closed), and the target control pressures P3tref and P4tref are equal to the delivery pressures of the third and fourth delivery ports. As a result, when the delivery pressures of the third and fourth delivery ports rise, the target control pressures P3tref and P4tref also rise while remaining equal to the delivery pressures of the third and fourth delivery ports. The gradients of straight lines representing the rates of rise in the target control pressures P3tref and P4tref in this instance are 1. When the delivery pressures of the third and fourth delivery ports reach the set pressures of the first and second relief valves 37*a* and 37*b*, the target control pressures P3tref and P4tref become constant at the set pressures of the first and second relief valves 37*a* and 37*b*.

When the LS drive pressure rises from the tank pressure, the opening areas AP3 and AP4 of the first and second pressure dividing valves 35*a* and 35*b* increase accordingly. As the delivery pressures of the third and fourth delivery ports rise, the target control pressures P3tref and P4tref rise at smaller rates (with smaller gradients of straight lines) as compared to the case where the opening areas AP3 and AP4 of the first and second pressure dividing valves 35*a* and 35*b* are zero (fully closed). As the LS drive pressure rises, the rates of rise (gradients of straight lines) in the target control pressures P3tref and P4tref are reduced, and the target control pressures P3tref and P4tref obtained at the same delivery pressures of the third and fourth delivery ports are lowered. When the delivery pressures of the third and fourth delivery ports reach the torque control start pressure Pb which is the set pressure of the first and second relief valves 37*a* and 37*b*, the target control pressures P3tref and P4tref become constant at the set pressure (Pb) of the first and second relief valves 37*a* and 37*b*.

When the LS drive pressure rises to a predetermined pressure Px2, the opening areas AP3 and AP4 of the first and second pressure dividing valves 35*a* and 35*b* become a max APmax (fully opened), and the target control pressures P3tref and P4tref become the tank pressure (zero).

As a result of that the target control pressures P3tref and P4tref thus vary when the delivery pressures of the third and fourth delivery ports rise, the torque control pressures P3t and P4t also vary like the target control pressures P3tref and P4tref, as illustrated in FIG. 5D. Specifically, when the LS drive pressure is the tank pressure (zero), the torque control pressures P3t and P4t are equal to the delivery pressures of the third and fourth delivery ports. As the LS drive pressure rises, the rates of rise (gradients of straight lines) in the torque control pressures P3t and P4t are reduced, and the torque control pressures P3t and P4t obtained at the same delivery pressures of the third and fourth delivery ports are lowered. When the delivery pressures of the third and fourth delivery ports reach the torque control start pressure Pb which is a set pressure of the first and second relief valves 37*a* and 37*b*, the torque control pressures P3t and P4t become constant at the set pressure (Pb) of the first and second relief valves 37*a* and 37*b*. When the LS drive pressure reaches a predetermined pressure Px2, the torque control pressures P3t and P4t become the tank pressure (zero).

It will be explained below that the torque control pressures P3t and P4t generated by the torque feedback circuit sections 30*a* and 30*b* are characteristics simulating the absorption torque of the second hydraulic pump 1*b* as aforementioned.

In the second pump control unit 5*b* shown in FIGS. 1A and 1B, assuming that the actual absorption torques of the third and fourth delivery ports P3 and P4 of the second hydraulic pump 1*b* are τ3 and τ4, the absorption torques τ3 and τ4 are calculated according to the following equations.

$$\tau 3=(P3p\times q2)/2\pi \quad (1)$$

$$\tau 4=(P4p\times q2)/2\pi \quad (2)$$

As aforementioned, P3p and P4p are the delivery pressures of the third and fourth delivery ports P3 and P4, and q2 is the tilting angle of the second hydraulic pump 1*b*.

In addition, in the case when limitation by the absorption torque constant control (or horsepower constant control) of the second torque control section 13*b* is not received, the tilting angle of the second hydraulic pump 1 is controlled by the second load sensing control section 12*b*. In this instance, the swash plate of the second hydraulic pump 1*b* receives the LS drive pressure Px2 and springs S3 and S4, and the tilting angle q2 is expressed by the following equation.

$$q2=q2\max-K\times Px2 \quad (3)$$

Here, K is a constant determined by the relation between the constants of the springs S3 and S4 and the tilting angle q2 (capacity) of the second hydraulic pump 1*b*, and is a value corresponding to the gradient K shown in FIG. 3.

On the other hand, in order to cause the torque control pressures P3t and P4t to be characteristics simulating the absorption torque of the second hydraulic pump 1*b*, it is necessary that biasing forces generated at the first and second torque reduction control pistons 31*a* and 31*b* by application of the torque control pressures P3t and P4t should be values proportional to the absorption torques τ3 and τ4 of the third and fourth delivery ports P3 and P4, and for ensuring this, the following relations must be established.

$$\tau 3=C(A\times P3t) \quad (4)$$

$$\tau 4=C(A\times P4t) \quad (5)$$

Here, A is a pressure-receiving area of the first and second torque reduction control pistons 31*a* and 31*b*, and C is a proportionality factor.

From the equations (1) to (5) above, the torque control pressures P3t and P4t are expressed by the following equations.

$$\tau 3=(P3p\times(q2\max-K\times Px2))/2\pi=C(A\times P3t)$$

$$\tau 4=(P4p\times(q2\max-K\times Px2))/2\pi=C(A\times P4t)$$

Deformation of these gives the following equations.

$$P3t=((P3p\times(q2\max-K\times Px2))/2\pi)/C\times A$$

$$P4t=((P4p\times(q2\max-K\times Px2))/2\pi)/C\times A$$

Substitution D=2π/C×A gives the following equations.

$$P3t=D(P3p\times(q2\max-K\times Px2)$$

$$P4t=D(P4p\times(q2\max-K\times Px2)$$

Setting the values of A and C such that D×q2max is 1 gives the following equations.

$$P3t=P3p\times(1-(K\times Px2/D)) \quad (6)$$

$$P4t=P4p\times(1-(K\times Px2/D)) \quad (7)$$

Figure 6:
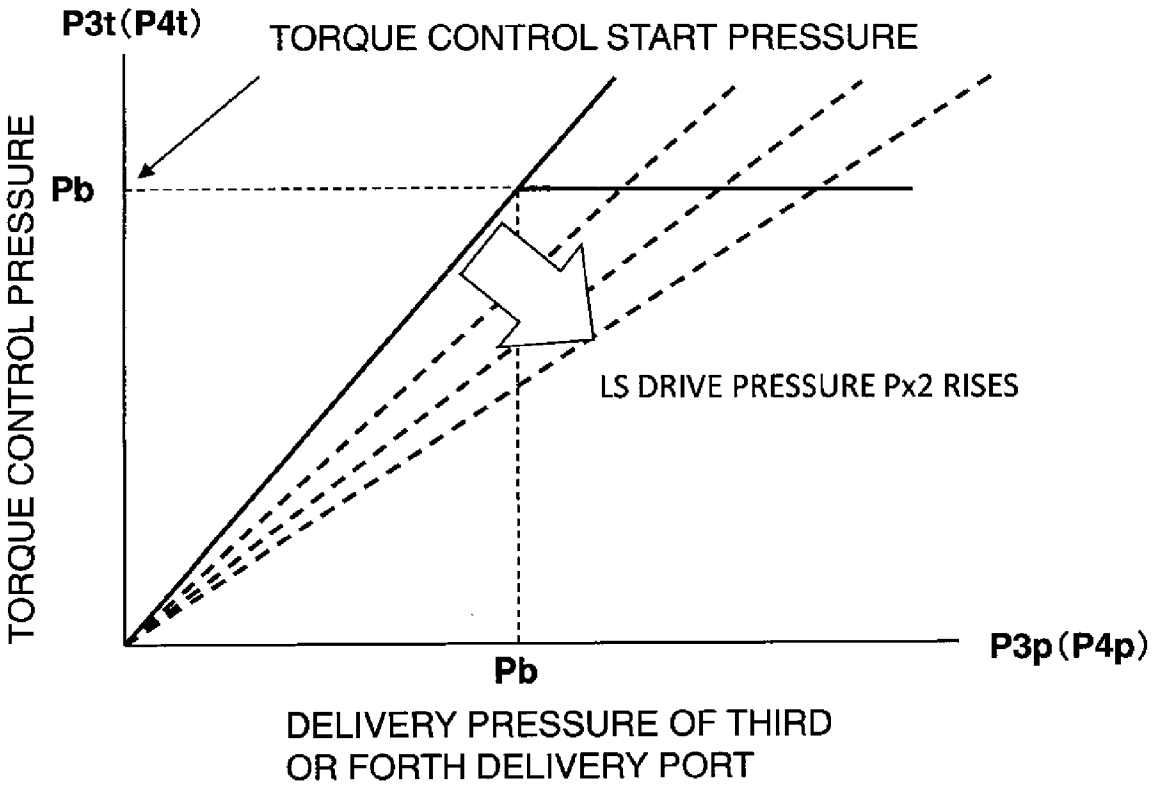
FIG. 6 is a diagram showing relations between the delivery pressure of the third and fourth delivery ports, torque control pressure and LS drive pressure represented by equation (6) and equation (7).

FIG. 6 is a diagram showing relations among the delivery pressures P3p and P4p of the third and fourth delivery ports, the torque control pressures P3t and P4t, and the LS drive pressure Px2 expressed by the equations (6) and (7).

As shown in FIG. 6, when the LS drive pressure Px2 is the tank pressure (zero) in the equations (6) and (7), the torque control pressures P3t and P4t are the same as the delivery pressures P3p and P4p of the third and fourth delivery ports. Besides, as the LS drive pressure Px2 rises, the value of (1−(K×Px2/D)) which is the gradients of straight lines representing the rates of rise in the torque control pressures P3t and P4t is reduced, and the torque control pressures P3t and P4t obtained at the same delivery pressures P3p and P4p of the third and fourth delivery ports are lowered. When the delivery pressures of the third and fourth delivery ports rise to the torque control start pressure Pb, the absorption torque constant control (or horsepower constant control) of the second torque control section 13*b* is started, and the absorption torque of the second hydraulic pump 1*b* becomes constant. Therefore, it is sufficient to set the torque control pressures P3t and P4t to be also constant at the torque control start pressure Pb.

As seen from FIGS. 5D and 6, the rates of increase (gradients of straight lines) of the torque control pressures P3t and P4t when the delivery pressures P3p and P4p of the third and fourth delivery ports rise as shown in FIG. 5D vary in such a manner as to be reduced as the LS drive pressure Px3 rises, like the rates of increase (gradients of straight lines) of the torque control pressures P3t and P4t when the delivery pressures P3p and P4p of the third and fourth delivery ports rise as shown in FIG. 6. When the torque control pressures P3t and P4t reach the torque control start pressure Pb which is a set pressure of the first and second relief valves 37*a* and 37*b*, the rates of increase (gradients of straight lines) become at the set pressure (Pb).

In this way, the torque control pressures P3t and P4t generated by the torque feedback circuit sections 30*a* and 30*b* are characteristics simulating the absorption torque of the second hydraulic pump 1*b*. The torque feedback circuit sections 30*a* and 30*b* have the function of modification, and outputting, the delivery pressure of a main pump 202 in such a manner as to provide characteristics simulating the absorption torque of the main pump 202 both in the cases of when the second hydraulic pump 1*b* is limited by control of the second torque control section 13*b* and operates at a maximum torque T2max (second maximum torque) and when the second hydraulic pump 1*b* is not limited by the second torque control section 13*b* and the second load sensing control section 12*b* controls the capacity of the second hydraulic pump 1*b* (when lower than the start pressure Pb of the absorption torque constant control).

Figure 7:
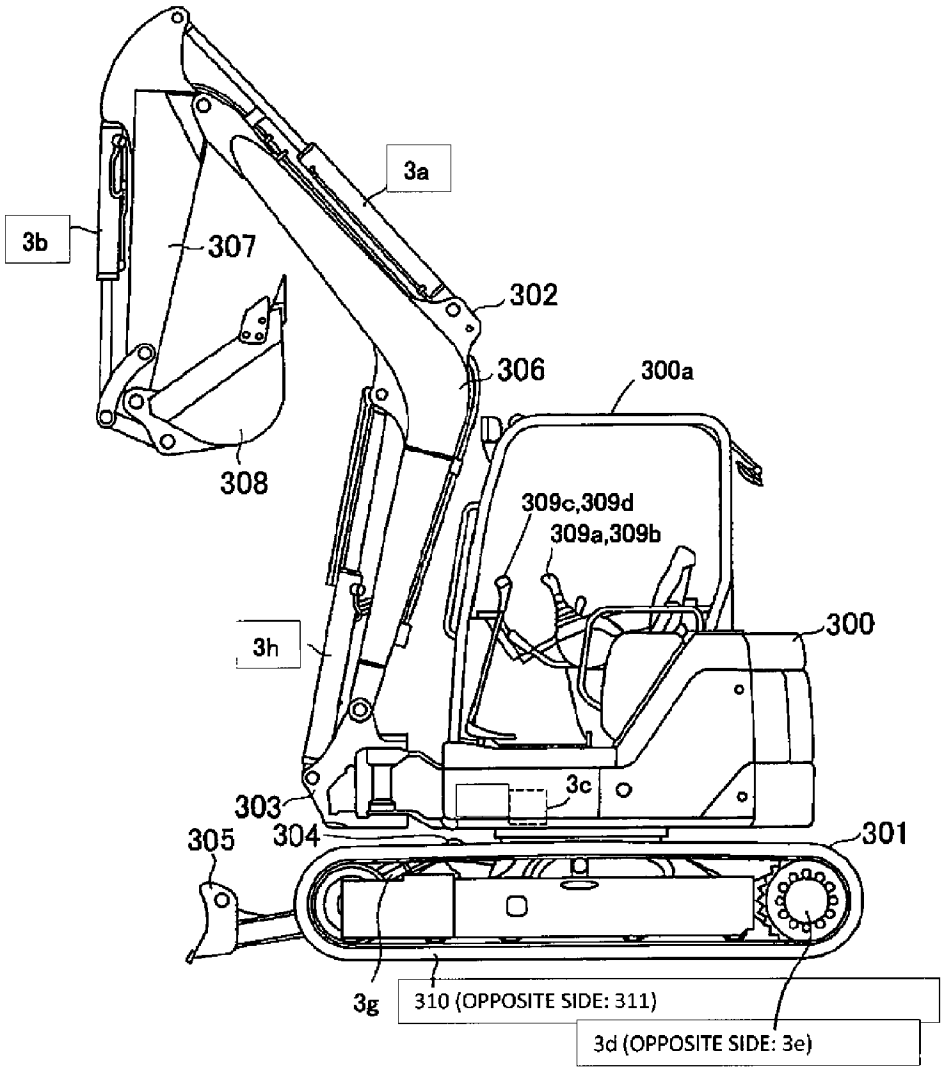
FIG. 7 is a view showing the external appearance of the hydraulic excavator.

FIG. 7 shows an external appearance of a hydraulic excavator.

In FIG. 7, the hydraulic excavator includes an upper swing structure 300, a lower track structure 301, and a front work device 302. The upper swing structure 300 is swingably mounted on the lower track structure 301, and the front work device 302 is connected to a front end portion of the upper swing structure 300 through a swing post 303 in such a manner as to rotate upward and downward and leftward and rightward. The lower track structure 301 includes left and right crawlers 310 and 311, and is provided on the front side of a track frame 304 with an earth removing blade 305 which is movable up and down. The upper swing structure 300 includes a cabin (operating room) 300*a*, in which are provided control lever devices 309*a* and 309*b* (only one of them is shown) for the front work device and for swing, and control lever/pedal devices 309*c* and 309*d* (only one of them is shown) for travelling. The front work device 302 is configured by connecting a boom 306, an arm 307, and a bucket 308 by using pins.

The upper swing structure 300 is driven to swing relative to the lower track structure 301 by a swing motor 3*c*. The front work device 302 is rotated horizontally by turning a swing post 303 by a swing cylinder 3*f* (see FIG. 1A). The left and right crawlers 310 and 311 of the lower track structure 301 are driven by left and right travelling motors 3*d* and 3*e*. The blade 305 is driven up and down by a blade cylinder 3*g*. In addition, the boom 306, the arm 307, and the bucket 308 are vertically rotated by extension/contraction of a boom cylinder 3*h*, an arm cylinder 3*a*, and a bucket cylinder 3*b*.

—Operation—

Operation of this embodiment will be described below.

<Single Drive>

<<Single Drive of Actuator on First Hydraulic Pump 1*a* Side>>

When an arm operation is conducted by singly driving one of actuators connected to the first hydraulic pump 1*a* side, for example, the arm cylinder 3*a*, an arm control lever is operated, whereon the flow control valves 6*a* and 6*e* are changed over, and hydraulic fluids delivered from the first and second delivery ports P1 and P2 are supplied to the arm cylinder 3*a* in a joining manner. Besides, in this instance, the delivery flow rates of the first and second delivery ports P1 and P2 are controlled by the load sensing control of the first load sensing control section 12*a* and the absorption torque constant control of the first torque control section 13*a*, as aforementioned.

When a bucket operation or a swing operation is conducted by singly driving the bucket cylinder 3*b* or the swing motor 3*c*, a relevant control lever is operated, whereon the flow control valve 6*b* or the flow control valve 6*d* is changed over, and the hydraulic fluid delivered from the delivery port P1 or P2 on one side is supplied to the bucket cylinder 3*b* or the swing motor 3*c*. Besides, in this instance, the delivery flow rates of the first and second delivery ports P1 and P2 are controlled by the load sensing control of the first load sensing control section 12*a* and the absorption torque constant control of the first torque control section 13*a*. The hydraulic fluid delivered from the delivery port P2 or P1 on the side of not supplying the hydraulic fluid to the bucket cylinder 3*b* or the swing motor 3*c* is returned to the tank by way of the unloading valve 10*b* or 10*a*.

<<Single Drive of Actuator on Second Hydraulic Pump 1*b* Side>>

When a boom operation is conducted by singly driving one of the actuators connected to the second hydraulic pump 1*b* side, for example, the boom cylinder 3*h*, a boom control lever is operated, whereon the flow control valves 6*h* and 6*l* are changed over, and hydraulic fluids delivered from the third and fourth delivery ports P3 and P4 are supplied to the boom cylinder 3*h* in a joining manner. Besides, in this instance, the delivery flow rates of the third and fourth delivery ports P3 and P4 are controlled by the load sensing control of the second load sensing control section 12*b* and the absorption torque constant control of the second torque control section 13*b*, as aforementioned.

When a swing operation or a blade operation is performed by singly driving the swing cylinder 3*f* or the blade cylinder 3*g*, a relevant control lever is operated, whereon the flow control valve 6*i* or the flow control valve 6*k* is changed over, and the hydraulic fluid delivered from the delivery port P3 or P4 on one side is supplied to the swing cylinder 3*f* or the blade cylinder 3*g*. Besides, in this instance also, the delivery flow rates of the third and fourth delivery ports P3 and P4 are controlled by the load sensing control of the second load sensing control section 12*b* and the absorption torque constant control of the second torque control section 13*b*. The hydraulic fluid delivered from the delivery port P4 or P3 on the side of not supplying the hydraulic fluid to the swing cylinder 3*f* or the blade cylinder 3*g* is returned to the tank by way of the unloading valve 10*d* or 10*c*.

<Simultaneous Drive of Actuator on First Hydraulic Pump 1*a* Side and Actuator on Second Hydraulic Pump 1*b* Side>

<<Simultaneous Drive of Arm Cylinder and Boom Cylinder>>

When a combined operation of the arm 307 and the boom 306 is conducted by simultaneously driving the arm cylinder 3*a* and the boom cylinder 3*h*, the arm control lever and the boom control lever are operated, whereon the flow control valves 6*a* and 6*e* and the flow control valves 6*h* and 6*l* are changed over, the hydraulic fluids delivered from the first and second delivery ports P1 and P2 are supplied to the arm cylinder 3*a* in a joining manner, and the hydraulic fluids delivered from the third and fourth delivery ports P3 and P4 are supplied to the boom cylinder 3*h* in a joining manner. Besides, on the first hydraulic pump 1*a* side and the second hydraulic pump 1*b* side, the delivery flow rates of the first and second delivery ports P1 and P2 and the delivery flow rates of the third and fourth delivery ports P3 and P4 are controlled by the load sensing control of the first and second load sensing control sections 12*a* and 12*b* and the absorption torque constant control of the first and second torque control sections 13*a* and 13*b*, as aforementioned. In addition, in the absorption torque constant control of the first torque control section 13*a*, the total torque control shown in FIG. 4A is conducted.

<<Simultaneous Drive of Swing Arm and Boom Cylinder>>

When a combined operation of the upper swing structure 300 (swing) and the boom 306 by simultaneously driving the swing motor 3*c* and the boom cylinder 3*h*, a swing control lever and the boom control lever are operated, whereon the flow control valve 6*d* and the flow control valves 6*h* and 6*l* are changed over, whereon the hydraulic fluid delivered from the second delivery port P2 is supplied to the swing motor 3*c*, and the hydraulic fluids delivered from the third and fourth delivery ports P3 and P4 are supplied to the boom cylinder 3*h* in a joining manner. Besides, on the first hydraulic pump 1*a* side and the second hydraulic pump 1*b* side, the delivery flow rates of the first and second delivery ports P1 and P2 and the delivery flow rates of the third and fourth delivery ports P3 and P4 are controlled by the load sensing control of the first and second lead sensing control sections 12*a* and 12*b* and the absorption torque constant control of the first and second torque control sections 13*a* and 13*b*, as aforementioned. In addition, in the absorption torque constant control of the first torque control section 13*a*, the total torque control shown in FIG. 4A is performed. The hydraulic fluid delivered from the first delivery port P1 on the side where the flow control valves 6*a* to 6*c* are closed is returned to the tank by way of the unloading valve 10*a*.

<<Simultaneously Drive of Other Combination of Actuator on First Hydraulic Pump 1*a* Side and Actuator on Second Hydraulic Pump 1*b* Side>>

In a combined operation other than the above-mentioned in which at least one of the actuators (arm cylinder 3*a*, bucket cylinder 3*b*, and swing motor 3*c*) connected only to the first and second delivery ports P1 and P2 of the first hydraulic pump 1*a* and at least one of the actuators (swing cylinder 3*f*, blade cylinder 3*g*, and boom cylinder 3*h*) connected only to the third and fourth delivery ports P3 and P4 of the second hydraulic pump 1*b* are simultaneously driven, also, the delivery flow rates of the first and second delivery ports P1 and P2 and the delivery flow rates of the third and fourth delivery ports P3 and P4 are controlled by the load sensing control and the absorption torque constant control, similarly to the above. Besides, in the absorption torque constant control of the first torque control section 13*a*, the total torque control shown in FIG. 4A is conducted. The hydraulic fluid delivered from the delivery port on the side where the flow control valve is closed is returned to the tank by way of the unloading valve.

<Simultaneous Drive of Two Actuators on First Hydraulic Pump 1*a* Side>

In a combined operation in which at least one of the actuators (arm cylinder 3*a*, bucket cylinder 3*b*, and travelling-right travelling motor 3*e*) connected to the first delivery port P1 of the first hydraulic pump 1*a* and at least one of the actuators (arm cylinder 3*a*, swing motor 3*c*, and travelling-left travelling motor 3*d*) connected to the second delivery port P2 of the first hydraulic pump 1*b* are simultaneously driven, the delivery flow rates of the first and second delivery ports P1 and P2 are controlled by the load sensing control of the first load sensing control section 12*a* and the absorption torque constant control of the first torque control section 13*a*, like in the case of the arm operation in which the arm cylinder 3*a* is singly driven. In addition, a surplus flow rate of the hydraulic fluid delivered from the delivery port on the side where the demanded flow rate is low or the hydraulic fluid delivered from the delivery port on the side where the flow control valve is closed is returned to the tank by way of the unloading valve. In this instance, a load pressure (maximum load pressure) of the actuators on the first delivery port P1 side that is detected by the first shuttle valve group 208*a* is introduced to the pressure compensating valves 7*a* to 7*c* and the first unloading valve 210*a*, whereas a load pressure (maximum load pressure) of the actuators on the second delivery port P2 side that is detected by the second shuttle valve group 208*b* is introduced to the pressure compensating valves 7*d* to 7*f* and the second unloading valve 210*b*, and controls by the pressure compensating valves and the unloading valve are performed separately on the first delivery port P1 side and on the second delivery port P2 side. This ensures that when the surplus flow rate of the delivery port on the low load pressure side is returned to the tank, the pressure of the delivery port is limited in rise based on the low load pressure by the unloading valve on the relevant delivery port side, and, accordingly, the pressure loss at the unloading valve at the time of returning of the surplus flow rate to the tank is reduced, and an operation with little energy loss can be achieved.

<Simultaneous Drive of Two Actuators on Second Hydraulic Pump 1*b* Side>

In a combined operation in which two actuators on the second hydraulic pump 1*b* side are simultaneously driven, also, the delivery flow rates of the third and fourth delivery ports P3 and P4 are controlled by the load sensing control of the second load sensing control section 12*b* and the second torque control section 13*b*, like in the aforementioned case of the combined operation in which two actuators on the first hydraulic pump 1*a* are simultaneously driven. In addition, a surplus flow rate of hydraulic fluid delivered from the delivery port on the side where the demanded flow rate is low or the hydraulic fluid delivered from the delivery port on the side where the flow control valve is closed is returned to the tank by way of the unloading valve, and, accordingly, the pressure loss at the unloading valve in this instance is reduced, and an operation with little energy loss can be achieved.

<Travelling Operation>

When a travelling operation is conducted by driving the travelling-left travelling motor 3*d* and the travelling-right travelling motor 3*e*, left and right travelling control levers or pedals are operated, whereon the flow control valves 6*f* and 6*j* and the flow control valves 6*c* and 6*g* are changed over, whereby the hydraulic fluid delivered from the second delivery port P2 of the first hydraulic pump 1*a* and the hydraulic fluid delivered from the fourth delivery port P4 of the second hydraulic pump 1*b* are supplied to the travelling-left travelling motor 3*d* in a joining manner, whereas the hydraulic fluid delivered from the first delivery port P1 of the first hydraulic pump 1*a* and the hydraulic fluid delivered from the third delivery port P3 of the second hydraulic pump 1*b* are supplied to the travelling-right travelling motor 3*e* in a joining manner. Therefore, even if the tilting angle of the swash plate of the first hydraulic pump 1*a* and the tilting angle of the swash plate of the second hydraulic pump 1*b* are different and a difference in delivery flow rate is generated between the first and second delivery ports P1 and P2 and the third and fourth delivery ports P3 and P4, the supply flow rate to the travelling-left travelling motor 3*d* and the supply flow rate to the travelling-right travelling motor 3*e* are the same, and, accordingly, the vehicle body can travel straight without meandering.

Specifically, assuming that the delivery flow rate of the first delivery port P1 is Q1, the delivery flow rate of the second delivery port P2 is Q2, the delivery flow rate of the third delivery port P3 is Q3, and the delivery flow rate of the fourth delivery port P4 is Q4, then the supply flow rate to the travelling-left travelling motor 3*d* and the supply flow rate to the travelling-right travelling motor 3*e* are as follows.

Travelling-left supply flow rate: Q2+Q4

Travelling-right supply flow rate: Q1+Q3

Here, the relations of Q1=Q2 (because of the same swash plate) and Q3=Q4 (because of the same swash plate) are established. Therefore, even if Q1=Q2≠Q3=Q4, the relation of $$Q2+Q4=Q1+Q3$$

is established, and, therefore, the supply flow rate to the travelling-left travelling motor 3*d* and the supply flow rate to the travelling-right travelling motor 3*e* are the same.

In this way, even if a difference in delivery flow rate is generated between the first and second delivery ports P1 and P2 and the third and fourth delivery ports P3 and P4, the supply flow rate to the travelling-left travelling motor 3*d* and the supply flow rate to the travelling-right travelling motor 3*e* are the same, and, accordingly, the vehicle body can travel straight without meandering.

<Travelling Combined Operation>

A case of performing a travelling combined operation in which the travelling motors 3*d* and 3*e* and at least one of other actuators, for example, the arm cylinder 3*a* are simultaneously driven will be described.

When the left and right travelling control levers or pedals and the arm control lever are operated with an intention to perform a travelling combined operation, the flow control valves 6*f* and 6*j*, the flow control valves 6*c* and 6*g* and the flow control valves 6*a* and 6*e* are changed over, and, simultaneously, the first communication control valve 215*a* is changed over to the communication position of the lower side in the drawing. With such arrangement, the hydraulic fluids delivered from the first and second delivery ports P1 and P2 are supplied from the first hydraulic pump 1*a* side in a joining manner and the hydraulic fluid delivered from the fourth delivery port P4 is supplied from the secondary hydraulic pump 1*b* side, to the travelling-left travelling motor 3*d*, whereas the hydraulic fluids delivered from the first and second delivery ports P1 and P2 are supplied from the first hydraulic pump 1*a* side in a joining manner and the hydraulic fluid delivered from the third delivery port P3 is supplied from the second hydraulic pump 1*b* side, to the travelling-right travelling motor 3*e*. The arm cylinder 3*a* is supplied with the remainder of the hydraulic fluids supplied to the travelling motors 3*d* and 3*e* from the first and second delivery ports P1 and P2.

In this instance, besides, on the first hydraulic pump 1*a* side, the first communication control valve 215*a* is changed over to the communication position of the lower side in the drawing. Therefore, the maximum load pressure of the actuators 3*a* to 3*e* that is detected by the first and second shuttle valve groups 208*a* and 208*b* is introduced to the load sensing control valves 216*a* and 216*b*, the pressure compensating valves 7*a* to 7*c* and 7*d* to 7*f* and the first unloading valves 210*a* and 210*b*, whereby the load sensing control and the controls of the pressure compensating valves and the unloading valves are performed. On the other hand, on the second hydraulic pump 1*b* side, the second communication control valve 215*b* is held in the interruption position of the upper side in the drawing. Therefore, the maximum load pressures are detected separately on the third delivery port P3 side and on the fourth delivery port P4 side, and the respective maximum load pressures are introduced to the load sensing control valves 216*c* and 216*d*, the pressure compensating valves 7*g* to 7*i* and 7*j* to 7*m* and the third and fourth unloading valves 210*c* and 210*d*, whereby the load sensing control and the controls of the pressure compensating valves and the unloading valves are performed.

Here, a case where straight travelling is conducted by a travelling combined operation will be described.

When the left and right travelling control levers or pedals are operated by the same amount with the intention to perform straight travelling by a travelling combined operation, the flow control valves are changed over such that the stroke amount (opening area) of the flow control valves 6*f* and 6*j* and the stroke amount (opening area–demanded flow rate) of the flow control valves 6*c* and 6*g* will be the same. In addition, as aforementioned, the hydraulic fluid delivered from the second delivery port P2 of the first hydraulic pump 1*a* and the hydraulic fluid delivered from the fourth delivery port P4 of the second hydraulic pump 1*b* are supplied to the travelling-left travelling motor 3*d* in a joining manner; the hydraulic fluids delivered from the first and second delivery ports P1 and P2 are supplied from the first hydraulic pump 1*a* side in a joining manner and the hydraulic fluid delivered from the fourth delivery port P4 is supplied from the second hydraulic pump 1*b* side, to the travelling-left travelling motor 3*d*; the hydraulic fluids delivered from the first and second delivery ports P1 and P2 are supplied from the first hydraulic pump 1*a* side in a joining manner and the hydraulic fluid delivered from the third delivery port P3 is supplied from the second hydraulic pump 1*b* side, to the travelling-right travelling motor 3*e*. This ensures that in the travelling combined operation, also, the supply flow rate to the travelling-left travelling motor 3*d* and the supply flow rate to the travelling-right travelling motor 3*e* are the same, and, therefore, the vehicle body can travel straight without meandering.

Specifically, assuming that the delivery flow rate of the first delivery port P1 is Q1, the delivery flow rate of the second delivery port P2 is Q2, the delivery flow rate of the third delivery port P3 is Q3, and the delivery flow rate of the fourth delivery port P4 is Q4, and that the flow rate of the hydraulic fluid supplied to the travelling-left travelling motor 3*d* is Qd, the flow rate of the hydraulic fluid supplied to the travelling-right travelling motor 3*e* is Qe, and the flow rate of the hydraulic fluid supplied to the boom cylinder 3*a* which is an actuator other than the travelling motors is Qa, the flow rates Qd and Qe of the hydraulic fluids supplied to the left and right travelling motors 3*d* and 3*e* are as follows.

First, each of the left and right travelling motor 3*d* and 3*e* is supplied with hydraulic fluid from the first hydraulic pump 1*a* side in an amount of ½ of Q1+Q2−Qa, the amount obtained by subtracting the flow rate Qa of the hydraulic fluid supplied to the boom cylinder 3*a* from the total flow rate Q1+Q2 of the hydraulic fluids delivered from the first and second deliver ports P1 and P2. The amount supplied is ½ of Q1+Q2−Qa because the stroke amount (opening area) of the flow control valve 6*f* and the stroke amount (opening area−demanded flow rate) of the flow control valve 6*c* are the same. In addition, each of the left and right travelling motors 3*d* and 3*e* is supplied with hydraulic fluid from the second hydraulic pump 1*b* side in an amount of ½ of the total flow rate Q3+Q4 of the hydraulic fluids delivered from the first and second delivery ports P1 and P2. In this case, also, the amount supplies is ½ of Q3+Q4 because the stroke amount (opening area) of the flow control valve 6*j* and the stroke amount (opening area−demanded flow rate) of the flow control valve 6*g* are the same. Accordingly, the flow rates Qd and Qe of the hydraulic fluids supplied to the left and right travelling motors 3*d* and 3*e* are expressed as follows.

$$\text{Travelling-right supply flow rate } Qd=(Q1+Q2-Qa)/2+(Q3+Q4)/2$$

$$\text{Travelling-left supply flow rate } Qe=(Q1+Q2-Qa)/2+(Q3+Q4)/2$$

In other words, Qd=Qe, and according, the vehicle body can travel straight without meandering.

The above-mentioned example of the travelling combined operation corresponds to the case where the travelling motors 3*d* and 3*e* and the arm cylinder 3*a* are simultaneously driven. As other example of the travelling combined operation, there is a travelling combined operation in which an actuator (bucket cylinder 3*b*, swing motor 3*c*) driven by the hydraulic fluid delivered only from the first delivery port P1 or the second delivery port P2 of the first hydraulic pump 1*a* or an actuator (swing cylinder 3*f*, blade cylinder 3*g*) driven by the hydraulic fluid delivered only from the third delivery port P3 or the fourth delivery port P4 of the second hydraulic pump 1*b* is driven simultaneously with the travelling motors. In this embodiment, in the case of performing such a travelling combined operation, also, the vehicle body can travel straight without meandering.

Note that in this embodiment, the first to fourth shuttle valve groups 208*a* to 208*d*, the first and second communication control valves 15*a* and 15*b*, the load sensing control valves 216*a* to 216*d* and the low pressure selection valves 221*a* and 221*b* are provided, and communication is established and interrupted with respect to both the delivery ports and the output hydraulic line of the maximum load pressure by the first and second communication control valves 15*a* and 15*b*. However, a structure in which communication is established and interrupted with respect to the delivery ports by the first and second communication control valves 15*a* and 15*b* may be adopted, and the other circuit structure may be the same as in the first embodiment. In this case, also, the first and second communication control valves 15*a* and 15*b* are changed over to the communication positions at the time of the travelling combined operation, whereby an effect to secure the straight travelling properties can be obtained.

—Effect—

The effects obtained by this embodiment will be described below.

Figure 8:
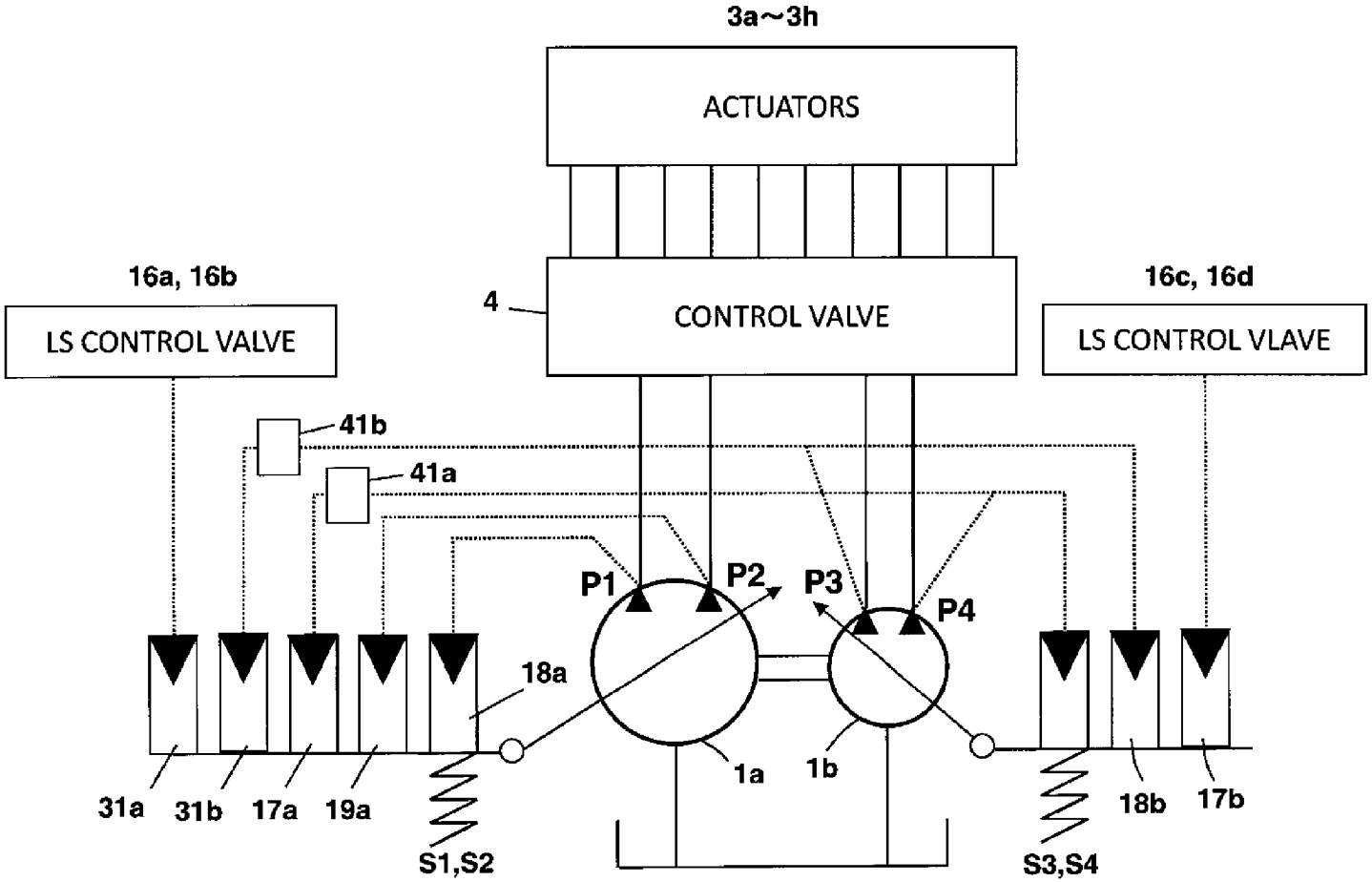
FIG. 8 is a diagram showing a hydraulic system in the case where the technology of total torque control described in Patent Document 2 is incorporated into a two-pump load sensing system including the first and second hydraulic pumps shown in FIG. 1, as a comparative example.

FIG. 8 is a diagram showing, as a comparative example, a hydraulic system in the case where the total torque control technology described in Patent Document 2 is incorporated into the two-pump load sensing system provided with the first and second hydraulic pumps 1*a* and 1*b* shown in FIG. 1. In the diagram, members equivalent to the elements shown in FIG. 1 are denoted by the same reference symbols as used above.

The hydraulic system of the comparative example shown in FIG. 8 includes pressure reduction valves 41*a* and 41*b* in place of the torque feedback circuit 30 (the first torque feedback circuit section 30*a* and the second torque feedback circuit section 30*b*). The pressure reduction valves 41*a* and 41*b* reduce the delivery pressures of the third and fourth delivery ports of the second hydraulic pump 1*b* in such a manner that the secondary pressures (torque control pressures) does not exceed a set pressure, and outputs the thus reduced pressures. The set pressure of the pressure reduction valves 41*a* and 41*b* is set to be a value (the start pressure Pb of the absorption torque constant control shown in FIG. 4B) corresponding to the maximum torque T2max set by the springs S3 and S4 in the torque control section of the second hydraulic pump 1*b*.

Figure 9:
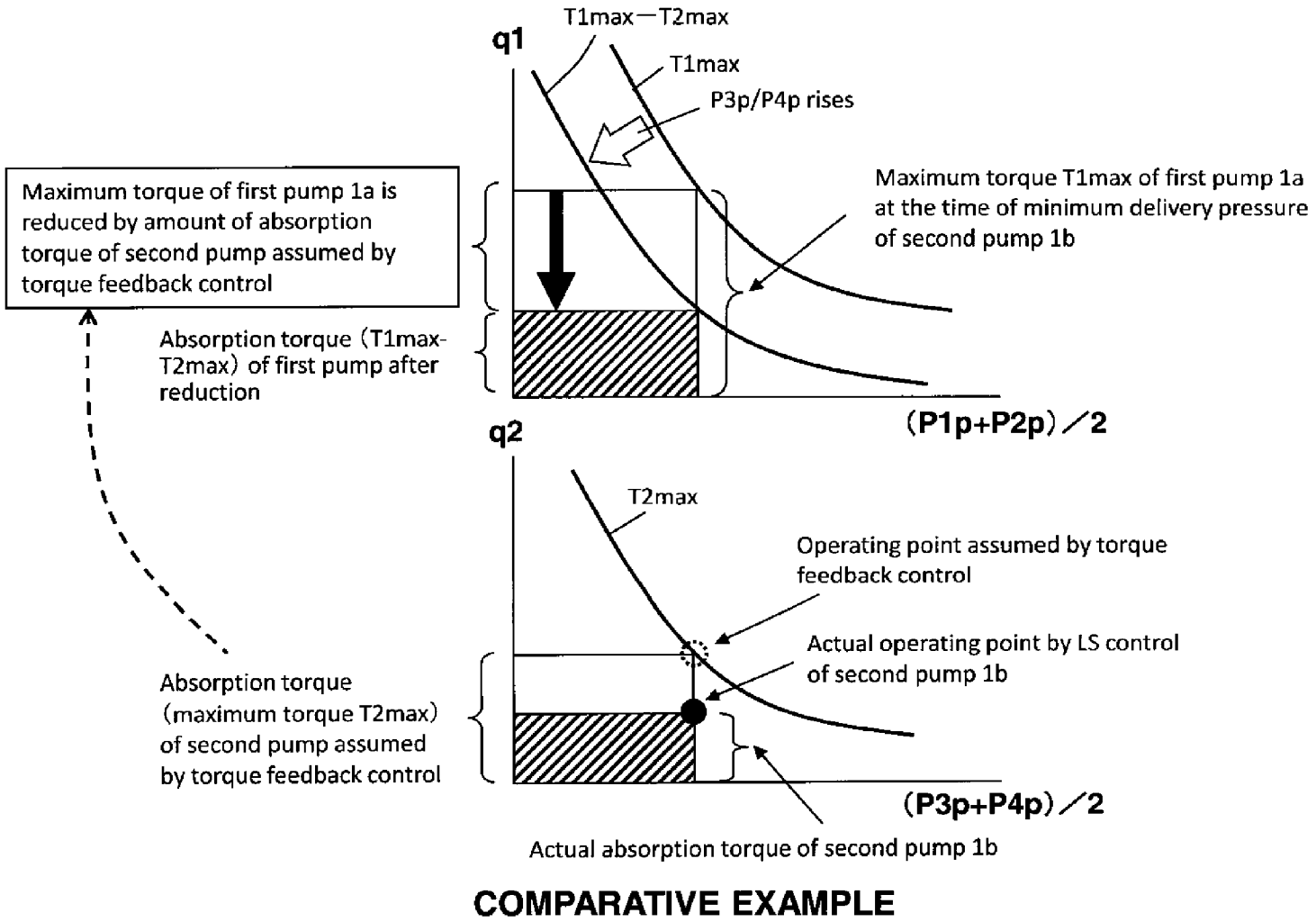
FIG. 9 is a diagram illustrating the total torque control according to the comparative example shown in FIG. 8.

FIG. 9 is a diagram showing the total torque control in the comparative example shown in FIG. 8. In the comparative example illustrated in FIG. 8, when the delivery pressures of the third and fourth delivery ports of the second hydraulic pump are equal to or higher than the start pressure of the absorption torque constant control, it is assumed that the second hydraulic pump 1*b* is under the absorption torque constant control. In this case, the pressure reduction valves 41*a* and 41*b* reduce the delivery pressures of the third and fourth delivery ports of the second hydraulic pump to a pressure corresponding to the maximum torque T2max, and introduce the thus reduced pressure to the torque reduction control pistons 31*a* and 31*b* of the first hydraulic pump 1*a*. On the first hydraulic pump 1*a* side, the maximum torque is reduced from T1max by an amount of T2max. In this way, the total torque control is carried out.

However, even when the delivery pressures of the third and fourth delivery ports of the second hydraulic pump are equal to or higher than the start pressure of the absorption torque constant control, there is a case where the second hydraulic pump 1*b* is not under the absorption torque constant control, and the second hydraulic pump 1*b* is controlled to a tilting angle smaller than the tilting that is limited under the absorption torque constant control by the load sensing control. In this case, the absorption torque of the second hydraulic pump 1*b* estimated with the pressure corresponding to the maximum torque T2max would be a value greater than the actual absorption torque of the second hydraulic pump 1*b*.

As a result, in the first hydraulic pump 1*a* where a pressure corresponding to the maximum torque T2max is introduced and the total torque control is conducted with the maximum torque of T1max−T2max, such a control as to reduce the maximum torque more than necessary would be performed, and, accordingly, the output torque of the prime mover cannot be used effectively.

Figure 10:
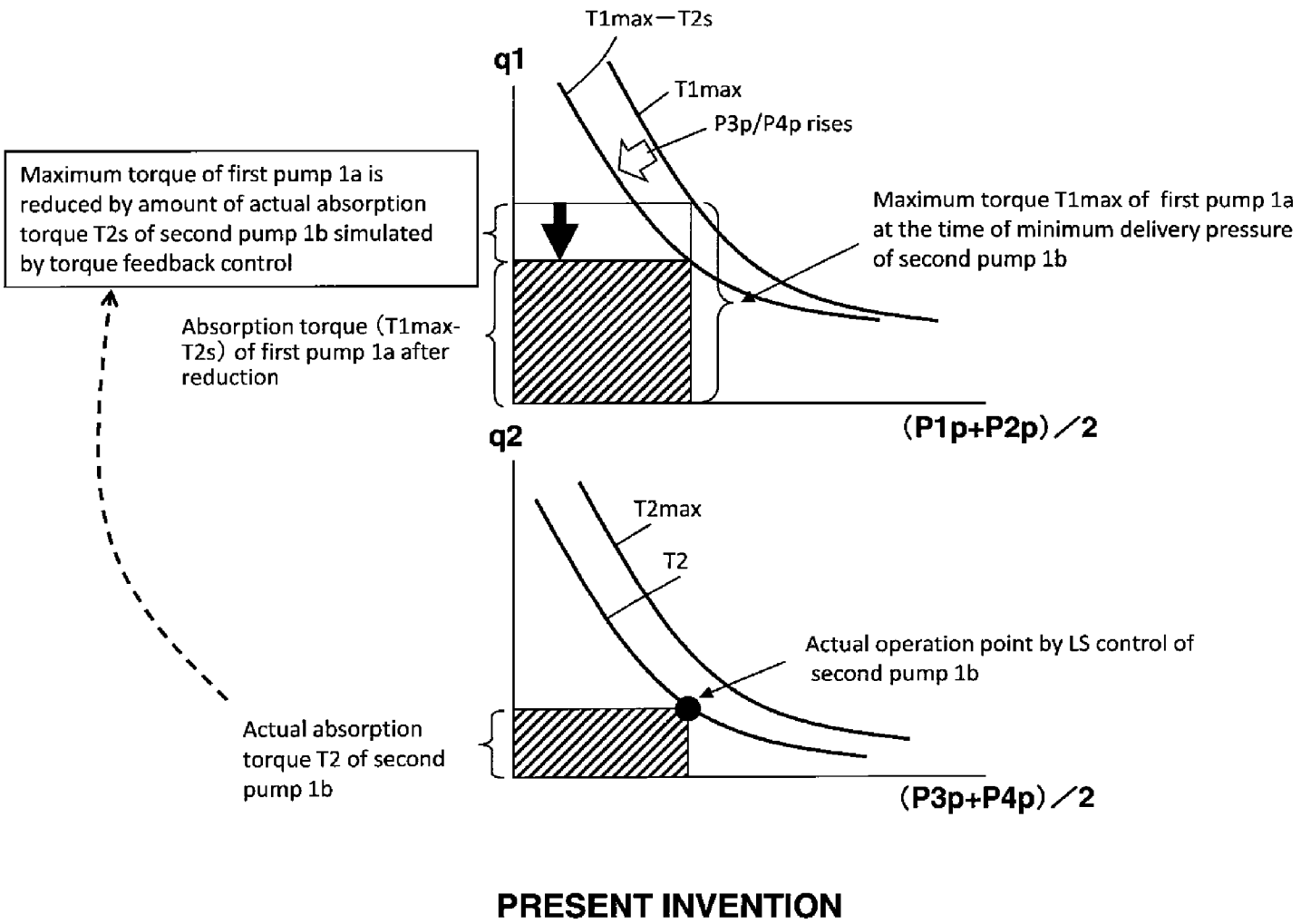
FIG. 10 is a diagram showing a total torque control according to the present embodiment.

FIG. 10 is a diagram showing a total torque control in this embodiment.

In this embodiment, the torque feedback circuit 30 modifies the delivery pressures of the third and fourth delivery ports P3 and P4 of the second hydraulic pump 1*b* in such a manner as to provide characteristics simulating the absorption torque of the second hydraulic pump 1*b* both in the cases of when the second hydraulic pump 1*b* is limited by control of the second torque control section 13*b* and operates at the maximum torque T2max (second maximum torque)

and when the second hydraulic pump 1*b* is not limited by the control of the second torque control section 13*b* and the second load sensing control section 12*b* controls the capacity of the second hydraulic pump 1*b* (when lower than the start pressure Pb of the absorption torque constant control of the second hydraulic pump 1*b*), and outputs the thus modified pressures. The first and second torque reduction control pistons 31*a* and 31*b* reduce the maximum torque T1max set in the first torque control section 13*a*, as the output pressure of the torque feedback circuit 30 becomes higher.

For example, as aforementioned, when the delivery pressures of the third and fourth delivery ports P3 and P4 of the second hydraulic pump 1*b* rise, the absorption torque of the second hydraulic pump 1*b* in that instance is T2 which is lower than the maximum torque T2max, and the absorption torque simulated by the torque feedback circuit 30 is T2s (≈T2), the torque feedback pistons 32*a* and 32*b* reduce the maximum torque T1max to T1max−T2s, as shown in FIG. 10, and the total torque control is conducted with the maximum torque T1max−T2s. As a result, the maximum torque is not reduced more than necessary, and stoppage of the engine 2 (engine stall) can be prevented, while making the most of the rated output torque TER of the engine 2.

As above-mentioned, according to this embodiment, the absorption torque of the second hydraulic pump 1*b* can be accurately detected by a purely hydraulic structure (torque feedback circuit 30). In addition, by feeding back the absorption torque to the first hydraulic pump 1*a* side, it is possible to accurately perform the total torque control and to effectively utilize the rated output torque TER of the prime mover 2. Besides, owing to the structure in which the absorption torque of the second hydraulic pump 1*b* is detected on a purely hydraulic basis, the first pump control unit 5*a* can be miniaturized, and the mountability of the hydraulic pump inclusive of the pump control unit is enhanced. Consequently, it is possible to provide a construction machine that is good in energy efficiency, is low in fuel cost, and is practical.

In addition, as shown in FIGS. 5C and 5D, the target control pressures formed in the first and second hydraulic lines 36*a* and 36*b* between the first and second pressure dividing restrictor parts (fixed restrictors) 34*a* and 34*b* and the first and second pressure dividing valves (variable restrictor valves) 35*a* and 35*b* and the torque control pressures outputted by the first and second pressure reduction valves 32*a* and 32*b* are pressures of the same values, and the pressures formed in the first and second hydraulic lines 36*a* and 36*b* can also be used directly as torque control pressures.

In the case where the pressures formed in the first and second hydraulic lines 36*a* and 36*b* are used directly as the torque control pressures, however, at the time of driving the third torque control actuators 32*a* and 32*b* with the torque control pressures, the first and second pressure dividing restrictor parts (fixed restrictors) 34*a* and 34*b* constitute resistances to make it difficult to supply sufficient quantities of hydraulic fluid to the third torque control actuators 32*a* and 32*b*, so that the responsiveness of the third torque control actuators 32*a* and 32*b* may be worsened.

Besides, in the case where hydraulic fluid is supplied from the first and second hydraulic lines 36*a* and 36*b* to the third torque control actuators 32*a* and 32*b*, pressure variations are liable to occur due to variations in the quantities of hydraulic fluid in the first and second hydraulic lines 36*a* and 36*b*, making it difficult for the pressures formed in the first and second hydraulic lines 36*a* and 36*b* to be accurately set to attain pressure variations as shown in FIG. 5C. Further, when the delivery pressure of the second hydraulic pump 1*b* fluctuates, the fluctuations in the delivery pressure may be transmitted directly to the third torque control actuators 32*a* and 32*b*, whereby stability of the system may be damaged.

In this embodiment, the pressures in the first and second hydraulic lines 36*a* and 36*b* between the first and second pressure dividing restrictor parts (fixed restrictors) 34*a* and 34*b* and the first and second pressure dividing valves (variable restrictor valves) 35*a* and 35*b* are introduced to the first and second pressure reduction valves 32*a* and 32*b* as target control pressures, thereby providing the set pressures for the first and second pressure reduction valves 32*a* and 32*b*, and the torque control pressure is generated from the delivery pressure of the second hydraulic pump 1*b* by the first and second pressure reduction valves 32*a* and 32*b*. Therefore, it is possible to secure the flow rates at the time of driving the third torque control actuators 32*a* and 32*b* with the torque control pressure, and to obtain good responsiveness at the time of driving the third torque control actuators 32*a* and 32*b*.

In addition, since the pressures in the first and second hydraulic lines 36*a* and 36*b* between the first and second pressure dividing restrictor parts (fixed restrictors) 34*a* and 34*b* and the first and twenty-second pressure dividing valves (variable restrictor valves) 35*a* and 35*b* are not used directly as the torque control pressures, the setting of the first and second pressure dividing restrictor parts (fixed restrictors) 34*a* and 34*b* and the first and twenty-second pressure dividing valves (variable restrictor valves) 35*a* and 35*b* for obtaining the required target control pressures and the setting of the responsiveness of the third torque control actuators 32*a* and 32*b* can be performed independently, so that the setting of the torque feedback circuit 30 for exhibiting required performance can be performed easily and accurately.

Further, when the delivery pressure of the second hydraulic pump 1*b* is higher than the set pressures of the first and second pressure reduction valves 32*a* and 32*b*, fluctuations in the delivery pressure of the second hydraulic pump 1*b* is blocked by the first and second pressure reduction valves 32*a* and 32*b*, and therefore do not influence the third torque control actuators 32*a* and 32*b*. Accordingly, the stability of the system is secured.

—Others—

While the case where the first and second hydraulic pumps are split flow type hydraulic pumps having the first and second delivery ports P1 and P2 and the third and fourth delivery ports P3 and P4, respectively, has been described in the embodiment above, both or one of the first and second hydraulic pumps may be a single flow type hydraulic pump having a single delivery port. In the case where the first and second hydraulic pumps are single flow type hydraulic pumps, it is sufficient that the torque feedback circuit 30 has one circuit section and one torque reduction control piston to which the torque control pressure is introduced. Besides, the axis of abscissas in FIGS. 4A and 4B then represents the pressure of the single delivery port (the delivery pressure of the hydraulic pump).

In addition, since in the torque feedback circuit 30 the target control pressures formed in the first and second hydraulic lines 36*a* and 36*b* between the first and second pressure dividing restrictor parts (fixed restrictors) 34*a* and 34*b* and the first and second pressure dividing valves (variable restrictor valves) 35*a* and 35*b* and the torque control pressures outputted by the first and second pressure reduction valves 32*a* and 32*b* are pressures of the same values as aforementioned, a structure may be adopted in which the pressures formed in the first and second hydraulic lines 36*a* and 36*b* are introduced directly to the torque reduction control actuators 31*a* and 31*b* as torque control pressures.

Besides, while in the embodiment above the first and second relief valves 37*a* and 37*b* have been provided in the torque feedback circuit 30 in such a manner that the pressures in the first and second hydraulic lines 36*a* and 36*b* between the first and second pressure dividing restrictor parts (fixed restrictors) 34*a* and 34*b* and the first and second pressure dividing valves (variable restrictor valves) 35*a* and 35*b* do not increase beyond the set pressure (torque start pressure Pb), pressure reduction valves may be used in place of the relief valves. In this case, by providing the set pressure of the pressure reduction valves at the torque start pressure Pb and using the output pressures of the pressure reduction valves as the target control pressures P35ref and P4tref, the same or similar function to the above can be obtained.

In addition, while the first pump control unit 5*a* has had the first load sensing control section 12*a* and the first torque control section 18*a*, the first load sensing control section 12*a* in the first pump control unit 5*a* is not indispensable, and other control system, such as the so-called positive control or negative control system may also be used so long as the system can control the capacity of the first hydraulic pump according to the operation amount of the control lever (flow control valve's opening area–demanded flow rate).

Further, the load sensing system in the embodiment above is an example, and the load sensing system may be modified variously. For instance, while the differential pressure reduction valve outputting the pump delivery pressure and the maximum load pressure as absolute pressures has been provided and its output pressure has been introduced to the pressure compensating valve to set the target compensating pressure and introduced to the LS control valve to set the target differential pressure for the load sensing control in the embodiment above, the pump delivery pressure and the maximum load pressure may be introduced to the pressure control valve and the LS control valve by way of different hydraulic lines.

DESCRIPTION OF REFERENCE CHARACTERS

1*a*: First hydraulic pump
1*b*: Second hydraulic pump
2: Prime mover (diesel engine)
3*a*-3*h*: Actuators
3*a*: Arm cylinder
3*d*: Left travelling motor
3*e*: Right travelling motor
3*h*: Boom cylinder
4: Control valve
5*a*: First pump control unit
5*b*: Second pump control unit
6*a*-6*m*: Flow control valves
7*a*-7*m*: Pressure compensating valves
8*a*: First shuttle valve group
8*b*: Second shuttle valve group
8*c*: Third shuttle valve group
8*d*: Fourth shuttle valve group
9*a*-9*d*: Springs
10*a*-10*d*: Unloading valves
12*a*: First load sensing control section
12*b*: Second load sensing control section
13*a*: First torque control section
13*b*: Second torque control section
15*a*: First communication control valve
15*b*: Second communication control valve
16*a*-16*d*: Load sensing control valves
17*a*, 17*b*: Load sensing control pistons (load sensing control actuators)
18*a*: First torque control piston (first torque control actuator)
19*a*: Second torque control piston (first torque control actuator)
18*b*: Third torque control piston (second torque control actuator)
19*b*: Fourth torque control piston (second torque control actuator)
21*a*, 21*b*: Low pressure selection valves
30: Torque feedback circuit
30*a*: First torque feedback circuit section
30*b*: Second torque feedback circuit section
31*a*: First torque reduction control piston (third torque control actuator)
31*b*: Second torque reduction control piston (third torque control actuator)
32*a*: First torque pressure reduction valve
32*b*: Second torque pressure reduction valve
33*a*: First pressure dividing circuit
33*b*: Second pressure dividing circuit
34*a*: First pressure dividing restrictor part
34*b*: Second pressure dividing restrictor part
35*a*: First pressure dividing valve
35*b*: First pressure dividing valve
36*a*: First hydraulic line
36*b*: Second hydraulic line
37*a*: First relief valve (pressure limiting valve)
37*b*: Second relief valve (pressure limiting valve)
P1, P2: First and second delivery ports
P3, P4: Third and Fourth delivery ports
S1, S2: Springs
S3, S4: Springs

The invention claimed is:

1. A hydraulic drive system for a construction machine, comprising:

a prime mover;

a variable displacement first hydraulic pump driven by the prime mover;

a variable displacement second hydraulic pump driven by the prime mover;

a plurality of actuators driven by hydraulic fluids delivered by the first and second hydraulic pumps;

a plurality of flow control valves that control flow rates of hydraulic fluids supplied from the first and second hydraulic pumps to the plurality of actuators;

a plurality of pressure compensating valves that control differential pressures across the plurality of flow control valves;

a first pump control unit that controls a delivery flow rate of the first hydraulic pump; and a second pump control unit that controls a delivery flow rate of the second hydraulic pump, the first pump control unit including a first torque control section that, when at least one of delivery pressure and capacity of the first hydraulic pump increases and absorption torque of the first hydraulic pump increases, controls the capacity of the first hydraulic pump such that the absorption torque of the first hydraulic pump does not exceed a first maximum torque, the second pump control unit including a second torque control section that, when at least one of delivery pressure and capacity of the second hydraulic pump increases and absorption torque of the second hydraulic pump increases, controls the capacity of the second hydraulic pump such that the absorption torque of the second hydraulic pump does not exceed a second maximum torque, and a load sensing control section that, when the absorption torque of the second hydraulic pump is lower than the second maximum torque, controls the capacity of the second hydraulic pump such that the delivery pressure of the second hydraulic pump becomes higher by a target differential pressure than a maximum load pressure of the actuators driven by a hydraulic fluid delivered by the second hydraulic pump, wherein the first torque control section includes a first torque control actuator that receives the delivery pressure of the first hydraulic pump and, when the delivery pressure rises, controls the capacity of the first hydraulic pump to decrease the capacity of the second hydraulic pump and decrease the absorption torque thereof, and first biasing means that sets the first maximum torque, the second torque control section includes a second torque actuator that receives the delivery pressure of the second hydraulic pump and, when the delivery pressure rises, controls the capacity of the second hydraulic pump to decrease the capacity of the second hydraulic pump and decrease the absorption torque thereof, and second biasing means that sets the second maximum torque, the load sensing control section includes a control valve that varies a load sensing drive pressure such that the load sensing drive pressure is lowered as a differential pressure between the delivery pressure of the second hydraulic pump and the maximum load pressure becomes smaller than the target differential pressure, and a load sensing control actuator that controls the capacity of the second hydraulic pump to increase the capacity of the second hydraulic pump and increase the delivery flow rate as the load sensing drive pressure becomes lower, the first pump control unit further includes a torque feedback circuit that receives the delivery pressure of the second hydraulic pump and the load sensing drive pressure and modifies the delivery pressure of the second hydraulic pump based on the delivery pressure of the second hydraulic pump and the load sensing drive pressure to provide a characteristic simulating the absorption torque of the second hydraulic pump both in the cases of when the second hydraulic pump is limited by control of the second torque control section and operates at the second maximum torque and when the second hydraulic pump is not limited by control of the second torque control section and the load sensing control section controls the capacity of the second hydraulic pump, and then outputs the modified delivery pressure as a torque control pressure, and a third torque control actuator that receives the torque control pressure and controls the capacity of the first hydraulic pump to decrease the capacity of the first hydraulic pump and decrease the first maximum torque as the torque control pressure becomes higher, the torque feedback circuit includes a fixed restrictor that receives the delivery pressure of the second hydraulic pump, a variable restrictor valve located in a downstream side of the fixed restrictor and connected to a tank in the downstream side thereof, and a pressure limiting valve connected to a hydraulic line between the fixed restrictor and the variable restrictor valve to control the pressure in the hydraulic line such that the pressure does not increase beyond a pressure that initiates the control of the second torque control section, the variable restrictor valve is configured such that the variable restrictor valve is fully closed when the load sensing drive pressure is at a lowest pressure and that the opening area of the variable restrictor valve increases as the load sensing drive pressure rises, and the torque feedback circuit generates the torque control pressure based on the pressure in the hydraulic line between the fixed restrictor and the variable restrictor valve, the torque control pressure being introduced to the third torque control actuator.

2. The hydraulic drive system for a construction machine according to claim 1, wherein the torque feedback circuit further includes a pressure reduction valve that receives the delivery pressure of the second hydraulic pump as a primary pressure, the pressure in the hydraulic line between the fixed restrictor and the variable restrictor valve is introduced to the pressure reduction valve as a target control pressure for providing a set pressure of the pressure reduction valve, and the pressure reduction valve outputs the delivery pressure of the secondary hydraulic pump as a secondary pressure without reduction when the delivery pressure of the second hydraulic pump is lower than the set pressure, and reduces the delivery pressure of the second hydraulic pump to the set pressure and outputs the thus lowered pressure when the delivery pressure of the second hydraulic pump is higher than the set pressure, the output pressure of the pressure reduction valve being introduced to the third torque control actuator as the torque control pressure.

3. The hydraulic drive system for a construction machine according to claim 2, wherein the pressure limiting valve is a relief valve.

4. The hydraulic drive system for a construction machine according to claim 2, wherein the pressure limiting valve is a relief valve.

* * * * *